US011760093B2

(12) United States Patent
Okui

(10) Patent No.: US 11,760,093 B2
(45) Date of Patent: Sep. 19, 2023

(54) LIQUID EJECTING HEAD AND LIQUID EJECTING APPARATUS

(71) Applicant: SEIKO EPSON CORPORATION, Tokyo (JP)

(72) Inventor: Hiroaki Okui, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/303,416

(22) Filed: May 28, 2021

(65) Prior Publication Data

US 2021/0370673 A1 Dec. 2, 2021

(30) Foreign Application Priority Data

| | | |
|---|---|---|
| Jun. 1, 2020 | (JP) | 2020-095323 |
| Jun. 17, 2020 | (JP) | 2020-104682 |
| Jun. 17, 2020 | (JP) | 2020-104700 |
| Jul. 27, 2020 | (JP) | 2020-126523 |
| Jul. 27, 2020 | (JP) | 2020-126544 |
| Aug. 31, 2020 | (JP) | 2020-145248 |
| Oct. 22, 2020 | (JP) | 2020-177407 |

(51) Int. Cl.
*B41J 2/14* (2006.01)

(52) U.S. Cl.
CPC ..... *B41J 2/1433* (2013.01)

(58) Field of Classification Search
CPC ..... B41J 2/1433; B41J 2/14201
See application file for complete search history.

(56) References Cited

U.S. PATENT DOCUMENTS

| | | | | |
|---|---|---|---|---|
| 2005/0285896 | A1 | 12/2005 | Hori | |
| 2010/0214359 | A1 | 8/2010 | Von Essen et al. | |
| 2017/0282553 | A1 | 10/2017 | Hayashi et al. | |
| 2017/0282562 | A1* | 10/2017 | Mizuno | B41J 2/145 |
| 2018/0009218 | A1 | 1/2018 | Tamura et al. | |
| 2020/0079086 | A1 | 3/2020 | Asai et al. | |

FOREIGN PATENT DOCUMENTS

| | | |
|---|---|---|
| EP | 3686013 | 7/2020 |
| JP | 2006-044234 A | 2/2006 |
| JP | 2012-200918 A | 10/2012 |

(Continued)

*Primary Examiner* — Jason S Uhlenhake
(74) *Attorney, Agent, or Firm* — WORKMAN NYDEGGER

(57) ABSTRACT

A liquid ejecting head includes head chips configured to eject a liquid toward a medium in a first-direction, in which, when a width direction of the medium is a second-direction, a direction orthogonal to the first-direction and the second-direction is a third-direction, and a direction perpendicular to the first-direction and intersecting the second-direction and the third-direction is a fourth-direction, the head chips include a first-chip group in which first head-chips are arranged side by side in the second-direction, the first-head chip having a first-nozzle row formed by arranging first-nozzles side by side in the fourth-direction, and a second-chip group in which second-head chips are arranged side by side in the second-direction, the second-head chip having a second-nozzle row formed by arranging second-nozzles side by side in the fourth-direction, and the first-chip group is arranged side by side in the third-direction with respect to the second-chip group.

20 Claims, 12 Drawing Sheets

(56) References Cited

FOREIGN PATENT DOCUMENTS

| | | | |
|---|---|---|---|
| JP | 2014-166755 | A | 9/2014 |
| JP | 2014-223749 | A | 12/2014 |
| JP | 2015-030181 | | 2/2015 |
| JP | 2016-055476 | A | 4/2016 |
| JP | 2017-177675 | A | 10/2017 |

* cited by examiner

LIQUID EJECTING HEAD AND LIQUID EJECTING APPARATUS

The present application is based on, and claims priority from JP Application Serial Number 2020-177407, filed Oct. 22, 2020, JP Application Serial Number 2020-095323, filed Jun. 1, 2020, JP Application Serial Number 2020-104700, filed Jun. 17, 2020, JP Application Serial Number 2020-104682, filed Jun. 17, 2020, JP Application Serial Number 2020-126523, filed Jul. 27, 2020, JP Application Serial Number 2020-126544, filed Jul. 27, 2020, and JP Application Serial Number 2020-145248, filed Aug. 31, 2020, the disclosures of which are hereby incorporated by reference herein in their entirety.

BACKGROUND

1. Technical Field

The present disclosure relates to a liquid ejecting head and a liquid ejecting apparatus.

2. Related Art

In the related art, as are represented by an ink jet printer, a liquid ejecting apparatus having a liquid ejecting head for ejecting a liquid such as ink has been known. For example, JP-A-2016-55476 discloses a liquid ejecting head in which a plurality of head chips having nozzle rows arranged obliquely with respect to a transport direction of a medium such as printing paper are arranged in a width direction of the medium and provided on a fixing plate, where a line head is constituted by a plurality of liquid ejecting heads arranged in the width direction of the medium.

However, when a plurality of line heads provided with the liquid ejecting heads in the related art are arranged in the transport direction in order to increase the resolution or support multiple colors, it is likely that print quality may deteriorate due to misalignment difference between the plurality of line heads.

SUMMARY

According to an aspect of the present disclosure, there is provided a liquid ejecting head including a plurality of head chips that eject a liquid toward a medium in a first direction, in which, when a width direction of the medium is a second direction, a direction orthogonal to the first direction and the second direction is a third direction, and a direction perpendicular to the first direction and intersecting the second direction and the third direction is a fourth direction, the plurality of head chips include a first chip group in which a plurality of first head chips are arranged side by side in the second direction, the first head chip having a first nozzle row formed by arranging a plurality of first nozzles side by side in the fourth direction, and a second chip group in which a plurality of second head chips are arranged side by side in the second direction, the second head chip having a second nozzle row formed by arranging a plurality of second nozzles side by side in the fourth direction, and the first chip group is arranged side by side in the third direction with respect to the second chip group.

According to another aspect of the present disclosure, there is provided a liquid ejecting apparatus including the liquid ejecting head described above and a transport portion that transports the medium.

According to still another aspect of the present disclosure, there is provided a liquid ejecting apparatus including a line head in which a plurality of the liquid ejecting heads described above are provided side by side in the second direction.

DESCRIPTION OF EXEMPLARY EMBODIMENTS

Hereinafter, embodiments for carrying out the present disclosure will be described with reference to the drawings. However, in each drawing, the dimensions and scale of each part are appropriately different from the actual ones. Further, since embodiments described below are preferred specific examples of the present disclosure, various technically preferable limitations are added; however, the scope of the present disclosure is not limited to these forms unless otherwise stated to limit the present disclosure in the following description.

1. FIRST EMBODIMENT

First, a liquid ejecting apparatus 100 according to a first embodiment will be described.

1.1. Outline of Liquid Ejecting Apparatus 100

Figure 1:
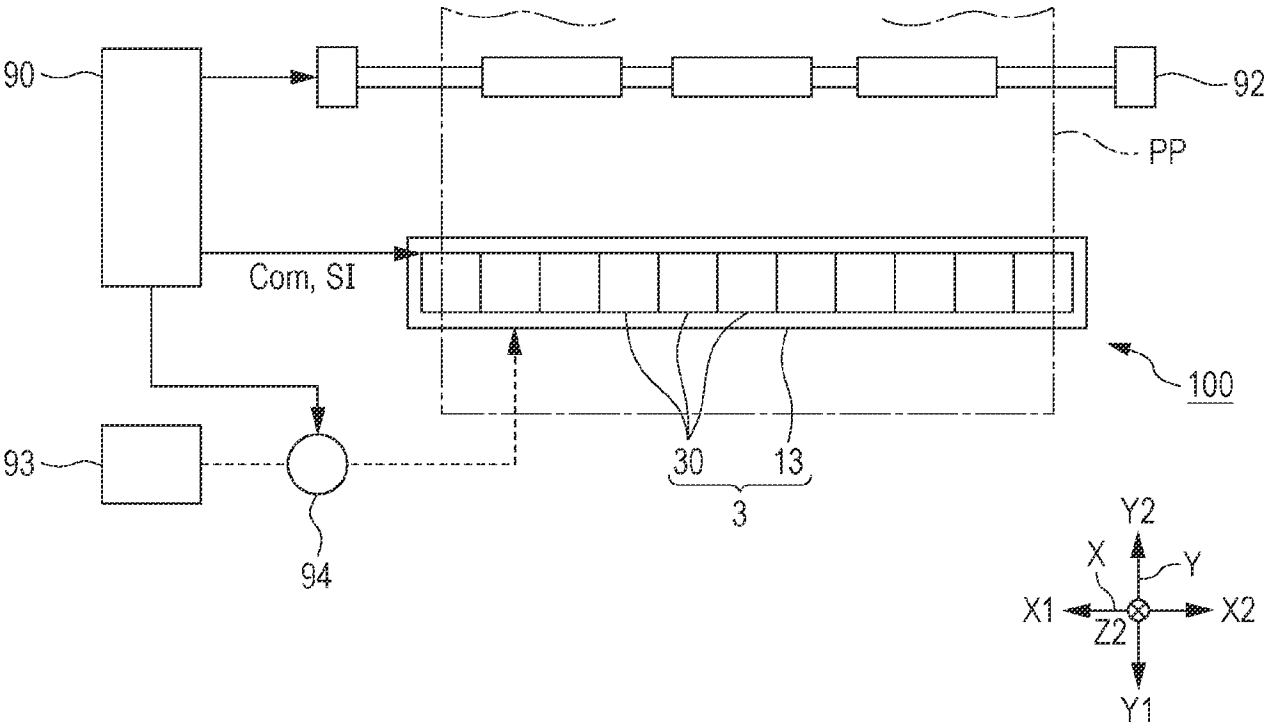
FIG. 1 is an explanatory view showing an example of a liquid ejecting apparatus according to a first embodiment.

FIG. 1 is an explanatory view showing an example of a liquid ejecting apparatus 100 according to a first embodiment. The liquid ejecting apparatus 100 according to the present embodiment is an ink jet-type printing apparatus that ejects ink, which is an example of a liquid, as droplets onto a medium PP. The liquid ejecting apparatus 100 of the present embodiment is a so-called line-type printing apparatus in which a plurality of nozzles N for ejecting ink are distributed over the entire range in the width direction of the medium PP. The medium PP is, for example, printing paper, but any print target such as a resin film or cloth can be used as the medium PP.

As illustrated in FIG. 1, the liquid ejecting apparatus 100 includes a liquid container 93 for storing ink. As the liquid container 93, for example, a cartridge that can be attached to and detached from the liquid ejecting apparatus 100, a bag-shaped ink pack made of a flexible film, an ink tank that can be refilled with ink, or the like can be employed. A plurality of types of ink having different colors are stored in the liquid container 93.

Although not illustrated, the liquid container 93 includes a first liquid container and a second liquid container. A first ink is stored in the first liquid container. A second ink of a type different from that of the first ink is stored in the second liquid container. For example, the first ink and the second ink are inks of different colors from each other. The first ink and the second ink may be inks of the same color.

As illustrated in FIG. 1, the liquid ejecting apparatus 100 includes a head module 3 having a plurality of liquid ejecting heads 30, a control device 90, a transport mechanism 92, and a circulation mechanism 94. The control device 90 includes, for example, a processing circuit such as a CPU or FPGA and a storage circuit such as a semiconductor memory, and controls each element of the liquid ejecting apparatus 100. Here, CPU is an abbreviation for central processing unit, and FPGA is an abbreviation for field programmable gate array.

The transport mechanism 92 transports the medium PP in a Y1 direction under the control of the control device 90. Hereinafter, the Y1 direction and a Y2 direction, which is the direction opposite to the Y1 direction, are collectively referred to as the Y-axis direction.

The head module 3 ejects the ink supplied from the liquid container 93 in a Z2 direction under the control of the control device 90. The Z2 direction is a direction orthogonal to the Y1 direction. Hereinafter, the Z2 direction and a Z1 direction, which is a direction opposite to the Z2 direction, may be collectively referred to as a Z-axis direction. The head module 3 will be described with reference to FIG. 2.

1.2. Head Module 3

Figure 2:
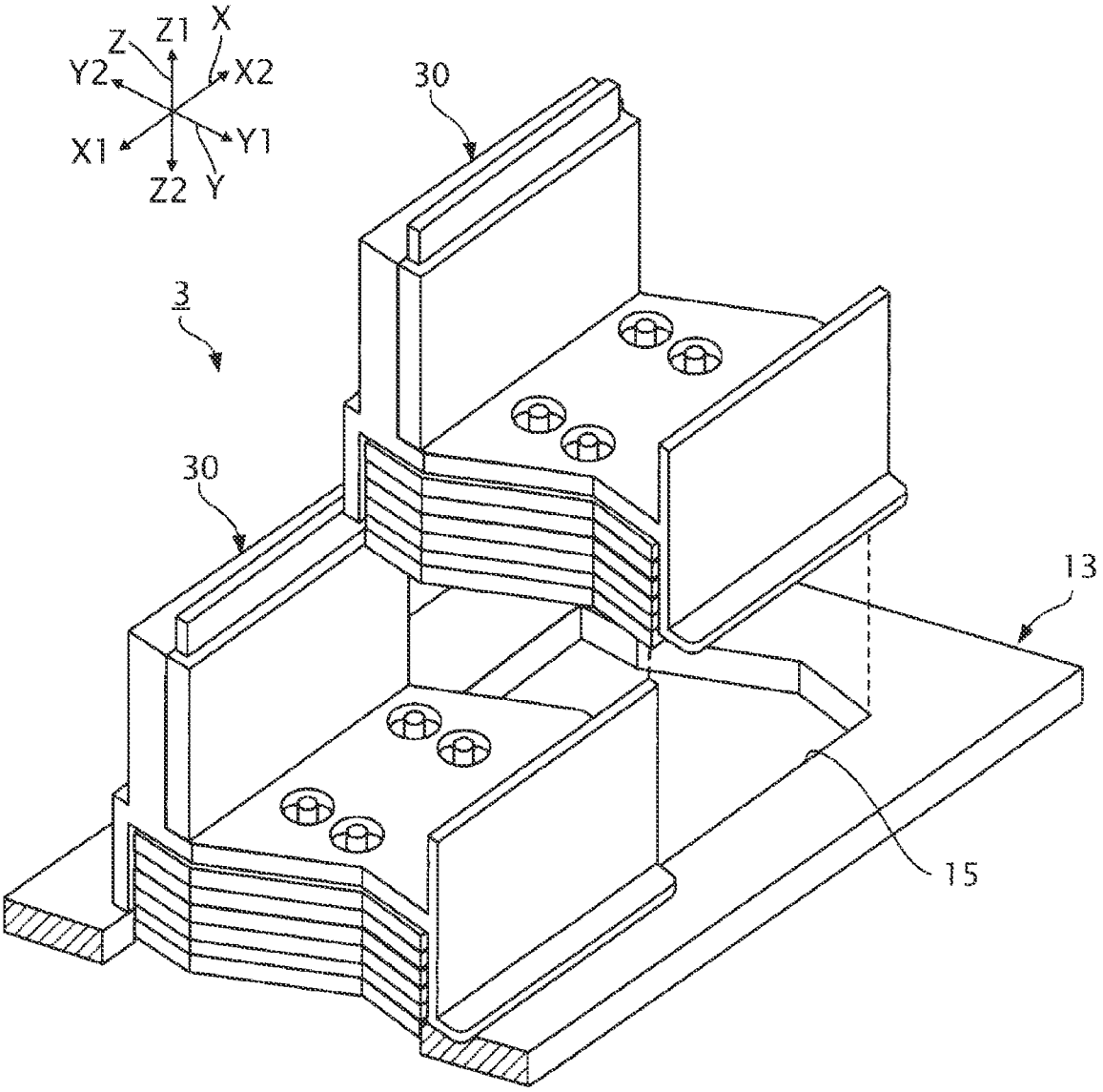
FIG. 2 is a perspective view of a head module.

FIG. 2 is a perspective view of the head module 3. The head module 3 includes the plurality of liquid ejecting heads 30 and a head fixing substrate 13 that holds the plurality of liquid ejecting heads 30. The plurality of liquid ejecting heads 30 are arranged side by side in an X1 direction and an X2 direction, which are directions orthogonal to the Y1 direction which is the transport direction, and are fixed to the head fixing substrate 13. The X2 direction is opposite to the X1 direction. Hereinafter, the X1 direction and the X2 direction may be collectively referred to as an X-axis direction. The head module 3 is a line head having the plurality of liquid ejecting heads 30 arranged so that a plurality of nozzles N are distributed over the entire range of the medium PP in the X-axis direction. That is, the plurality of liquid ejecting heads 30 constitute a long line head in the X-axis direction. By ejecting ink from the plurality of liquid ejecting heads 30 in parallel with the transport of the medium PP by the transport mechanism 92, an image by ink is formed on the surface of the medium PP. The head module 3 may be a long line head in a extending direction of the X axis, which includes only a single liquid ejecting head 30 disposed so that a plurality of nozzles N are distributed over the entire range of the medium PP in the X-axis direction. The head fixing substrate 13 has a plurality of mounting holes 15 for mounting the liquid ejecting head 30. The liquid ejecting head 30 is supported by the head fixing substrate 13 in a state of being inserted into the mounting hole 15.

Description will be made referring back to FIG. 1. The transport mechanism 92 transports the medium PP to the head module 3 in the Y-axis direction. In the example shown in FIG. 1, the liquid container 93 is coupled to the head module 3 via the circulation mechanism 94. The circulation mechanism 94 is a mechanism for supplying ink to each of the plurality of liquid ejecting heads 30 and collecting the ink discharged from each of the plurality of liquid ejecting heads 30 for resupply to the liquid ejecting heads 30. The circulation mechanism 94 includes, for example, a sub tank for storing ink, a flow path for supplying ink from the sub tank to the liquid ejecting heads 30, a flow path for collecting ink from the liquid ejecting heads 30 to the sub tank, and a pump for appropriately flowing ink. By the operation of the circulation mechanism 94, it is possible to suppress an increase in the viscosity of the ink and reduce the retention of air bubbles in the ink.

As illustrated in FIG. 1, the control device 90 supplies the liquid ejecting heads 30 with a drive signal Com for driving the liquid ejecting heads 30 and a control signal SI for controlling the liquid ejecting heads 30. Then, the liquid ejecting heads 30 are driven by the drive signal Com under the control of the control signal SI, and ejects ink in the Z2 direction from a part or all of the plurality of nozzles N provided in the liquid ejecting heads 30. The nozzle N will be described later in FIGS. 5 and 6.

Figure 3:
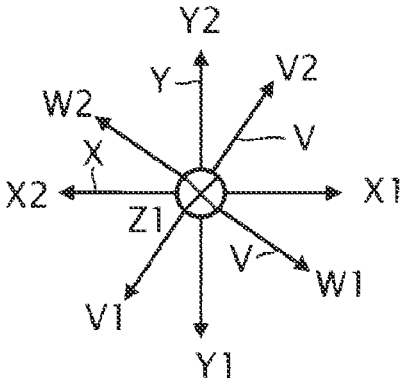
FIG. 3 is a diagram of a plurality of liquid ejecting heads when viewed in a Z1 direction.
Figure 3:
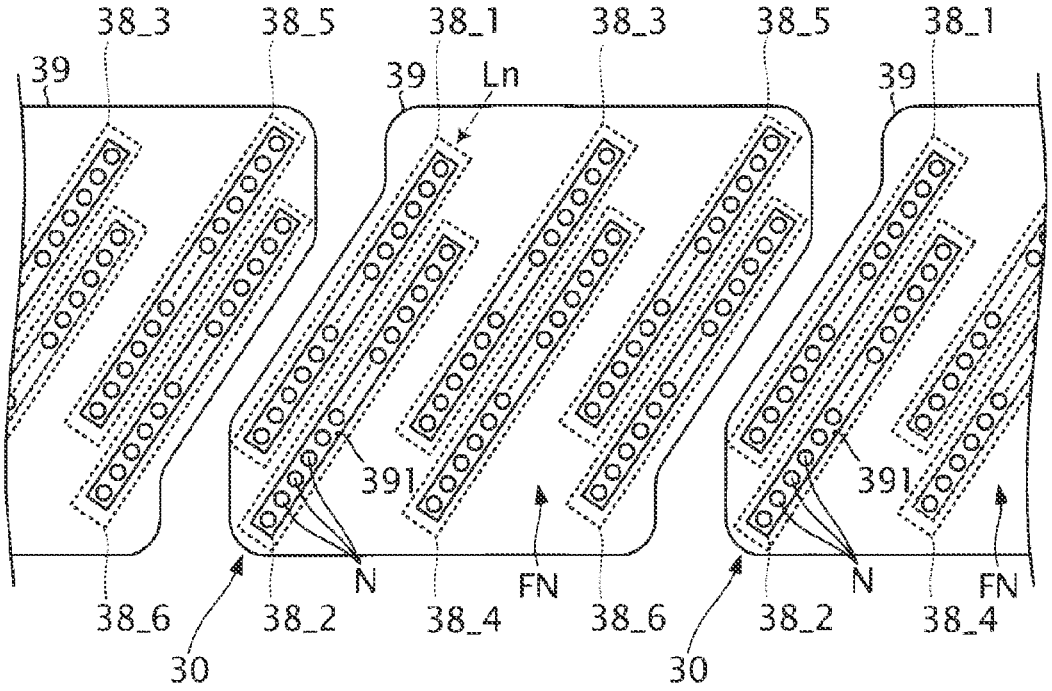

FIG. 3 is a diagram of the plurality of liquid ejecting heads 30 when viewed in a Z1 direction. Each of the plurality of liquid ejecting heads 30 has a plurality of head chips 38 and a fixing plate 39. In the first embodiment, one liquid ejecting head 30 has six head chips 38. In the following description, when head chips 38 are distinguished from each other, they are described as head chips 38_1, 38_2, 38_3, 38_4, 38_5, and 38_6, respectively, and when the head chips 38 are not distinguished, they are referred to as head chips 38.

Figure 4:
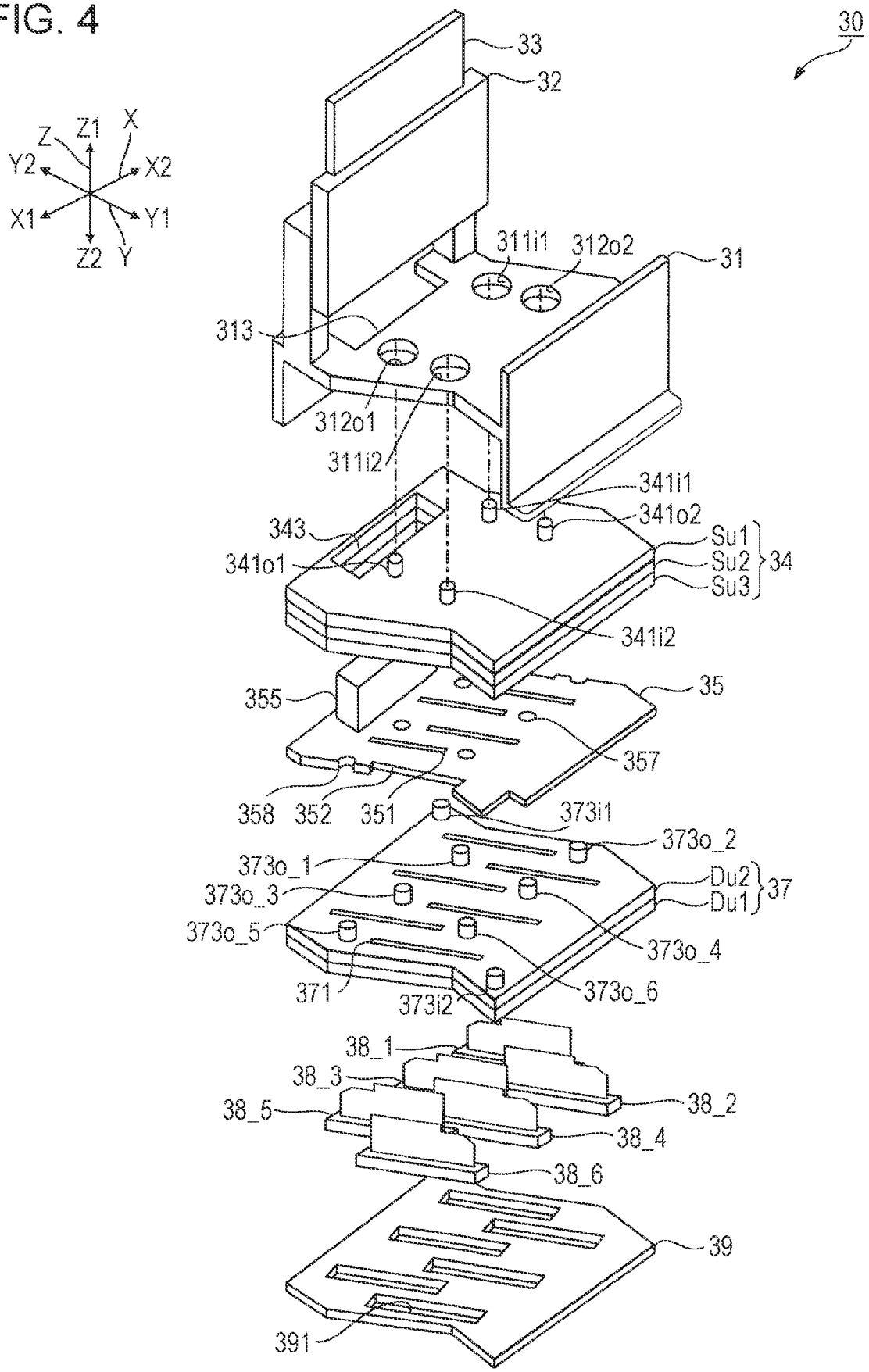
FIG. 4 is an exploded perspective view of the liquid ejecting head.

The fixing plate 39 is a plate member for fixing each of the plurality of head chips 38 to a holder 37 shown in FIG. 4. Further details of the fixing plate 39 will be described later.

The plurality of head chips 38 are each arranged so as to extend in a V2 direction. The V2 direction is perpendicular to the Z-axis direction, intersects the X-axis direction and the Y-axis direction, and is a direction between the X1 direction and the Y2 direction. The direction opposite to the V2 direction is referred to as a V1 direction. Further, the V1 direction and the V2 direction are collectively referred to as a V-axis direction. Further, the directions perpendicular to the Z-axis direction and the V-axis direction are referred to as a W1 direction and a W2 direction. The W1 direction is the direction between the X1 direction and the Y1 direction, and the W2 direction is the direction between the X2 direction and the Y2 direction. The W1 direction and the W2 direction are collectively referred to as a W-axis direction.

The V2 direction is an example of the "fourth direction", and the W1 direction is an example of the "fifth direction".

Each of the plurality of head chips 38 has a nozzle row Ln. The nozzle row Ln is formed by arranging M nozzles N in the V2 direction. M is an integer equal to or greater than 2. For example, the nozzles N included in one head chip 38 is arranged in enough numbers to provide 600 dpi in the X-axis direction. For simplification of the description, the resolution achieved by one head chip 38 is referred to as a "single unit resolution".

1.3. Liquid Ejecting Head 30

FIG. 4 is an exploded perspective view of the liquid ejecting head 30. As shown in FIG. 4, the liquid ejecting head 30 has a housing 31, a cover substrate 32, an aggregate substrate 33, a flow path structure 34, a wiring substrate 35, a holder 37, and the fixing plate 39. Further, the liquid ejecting head 30 has head chips 38_1, 38_2, 38_3, 38_4, 38_5, and 38_6 as illustrated in FIG. 3.

The flow path structure 34 includes a flow path plate Su1, a flow path plate Su1, a flow path plate Su3, a coupling pipe

341*i*1, a coupling pipe 341*i*2, a coupling pipe 341*o*1, a coupling pipe 341*o*2, and a connector hole 343.

The holder 37 includes a flow path member Du1, a flow path member Dug, a coupling pipe 373*i*1, a coupling pipe 373*i*2, a coupling pipe 373*o*_1, a coupling pipe 373*o*_2, a coupling pipe 373*o*_3, a coupling pipe 373*o*_4, a coupling pipe 373*o*_5, and a coupling pipe 373*o*_6. In the following description, the coupling pipe 373*i*1, the coupling pipe 373*i*2, the coupling pipe 373*o*_1, the coupling pipe 373*o*_2, the coupling pipe 373*o*_3, the coupling pipe 373*o*_4, the coupling pipe 373*o*_5, and the coupling pipe 373*o*_6 are collectively referred to as a coupling pipe 373. Further, the holder 37 has six openings 371 that penetrate in the Z-axis direction.

The housing 31 supports the flow path structure 34, the wiring substrate 35, the holder 37, and the fixing plate 39. Further, the housing 31 has a supply hole 311*i*1, a supply hole 311*i*2, a discharge hole 312*o*1, a discharge hole 312*o*2, and an aggregate substrate hole 313. The coupling pipe 341*i*1 is inserted into and fitted into the supply hole 311*i*1. The coupling pipe 341*i*2 is inserted into and fitted into the supply hole 311*i*2. The coupling pipe 341*o*1 is inserted into and fitted into the discharge hole 312*o*1. The coupling pipe 341*o*2 is inserted into and fitted into the discharge hole 312*o*2. The aggregate substrate 33 is inserted into the aggregate substrate hole 313. The housing 31 is made of metal or resin. Alternatively, the housing 31 may be made of a member of which the resin surface is covered with a metal film.

The cover substrate 32 holds the aggregate substrate 33 with a portion of the housing 31 extending in the Z1 direction. The aggregate substrate 33 is a substrate on which wiring is formed for transmitting the drive signal Com and the control signal SI supplied from the control device 90 to each of the plurality of head chips 38. The aggregate substrate 33 is a plate-shaped member extending parallel to the XZ plane. Here, the concept of "parallel" includes, in addition to being completely parallel, being regarded as parallel, for example, considering the error generated due to the manufacturing error of the liquid ejecting head 30 even though designed to be parallel.

The flow path structure 34 is a structure with a flow path provided inside for flowing ink between the circulation mechanism 94 and each of the plurality of head chips 38. The flow path structure 34 is disposed between the housing 31 and the wiring substrate 35. The flow path plate Su1, the flow path plate Su1, and the flow path plate Su3 included in the flow path structure 34 are stacked in this order in the Z1 direction. The flow path plate Su1, the flow path plate Su1, and the flow path plate Su3 are joined to each other by an adhesive or the like. The flow path plate Su1, the flow path plate Su1, and the flow path plate Su3 are formed, for example, by injection molding of a resin. A connector 355 of the wiring substrate 35 is inserted into the connector hole 343.

The coupling pipe 341*i*1 introduces the first ink supplied from the first liquid container into the holder 37. The coupling pipe 341*i*2 causes the second ink supplied from the second liquid container to be introduced into the holder 37. The coupling pipe 341*o*1 discharges the first ink discharged from the holder 37 to the outside of the liquid ejecting head 30. The coupling pipe 341*o*2 discharges the second ink discharged from the inside of the holder 37 to the outside of the liquid ejecting head 30.

The wiring substrate 35 is a mounting component for electrically coupling the liquid ejecting head 30 to the control device 90. The wiring substrate 35 is a substrate on which wiring is formed for transmitting various control signals and power supply voltages to the head chip 38. The wiring substrate 35 is a plate-shaped member extending parallel to the XY plane, and is disposed between the flow path structure 34 and the holder 37. The wiring substrate 35 is, for example, a rigid substrate. The wiring substrate 35 has the connector 355, four openings 351 and two notches 352, four openings 357, and two notches 358. As illustrated in FIG. 4, the four openings 351 and the two notches 352 are arranged in zigzags. The connector 355 is inserted into the connector hole 343 and electrically coupled to the aggregate substrate 33.

Any one of the coupling pipes 373*o*_1, 373*o*_3, 373*o*_4, and 373*o*_6 is inserted into each of the four openings 357. Any one of the coupling pipes 373*o*_2 and 373*o*_5 is inserted through the two notches 358.

The holder 37 is disposed between the wiring substrate 35 and the fixing plate 39, and is fixed to the fixing plate 39 with an adhesive. Therefore, the holder 37 reinforces the fixing plate 39. The holder 37 is also a structure with a flow path provided inside for flowing ink between the circulation mechanism 94 and each of the plurality of head chips 38. The flow path member Du1 and the flow path member Dug included in the holder 37 are stacked in this order in the Z1 direction. The holder 37 is made of, for example, resin or metal. The holder 37 has a recess (not shown) for accommodating the plurality of head chips 38 on the surface lying in the Z2 direction, and holds the plurality of head chips 38 so as to arrange the plurality of head chips 38 between the recess and the fixing plate 39.

The coupling pipe 373*i*1 communicates with any one of a plurality of discharge ports (not shown) formed on the surface of the flow path structure 34 in the Z2 direction, and introduces the first ink from the flow path structure 34 into the holder 37. The first ink introduced into the holder 37 is distributed in the holder 37 and supplied to the head chips 38_1, 38_3, and 38_5. The first ink discharged from the head chips 38_1, 38_3, and 38_5 is introduced into the holder 37. The coupling pipes 373*o*_1, 373*o*_3, and 373*o*_5 communicate with any one of a plurality of inlets (not shown) formed on the surface of the flow path structure 34 in the Z2 direction, and introduce the first ink flows from the holder 37 into the flow path structure 34.

The coupling pipe 373*i*2 communicates with any one of a plurality of discharge ports (not shown) formed on the surface of the flow path structure 34 in the Z2 direction, and introduces the second ink from the flow path structure 34 into the holder 37. The second ink introduced into the holder 37 is distributed in the holder 37 and supplied to the head chips 38_2, 38_4, and 38_6. The second ink discharged from the head chips 38_2, 38_4, and 38_6 is introduced into the holder 37. The coupling pipes 373*o*_2, 373*o*_4, and 373*o*_6 communicate with any one of a plurality of inlets (not shown) formed on the surface of the flow path structure 34 in the Z2 direction, and introduce the second ink flows from the holder 37 into the flow path structure 34.

Wiring members 388 of the plurality of head chips 38 are inserted into the six openings 371, respectively. The six openings 371 are arranged in zigzags.

One head chip 38 has one nozzle plate 387 and a piezoelectric element PZq corresponding to M nozzles N of the head chip 38. The six head chips 38 are also arranged in zigzags, similar to the openings 351 and the notches 352 of the wiring substrate 35. The head chip 38 will be described in more detail with reference to FIGS. 5 and 6.

1.3. Head Chip 38

Figure 5:
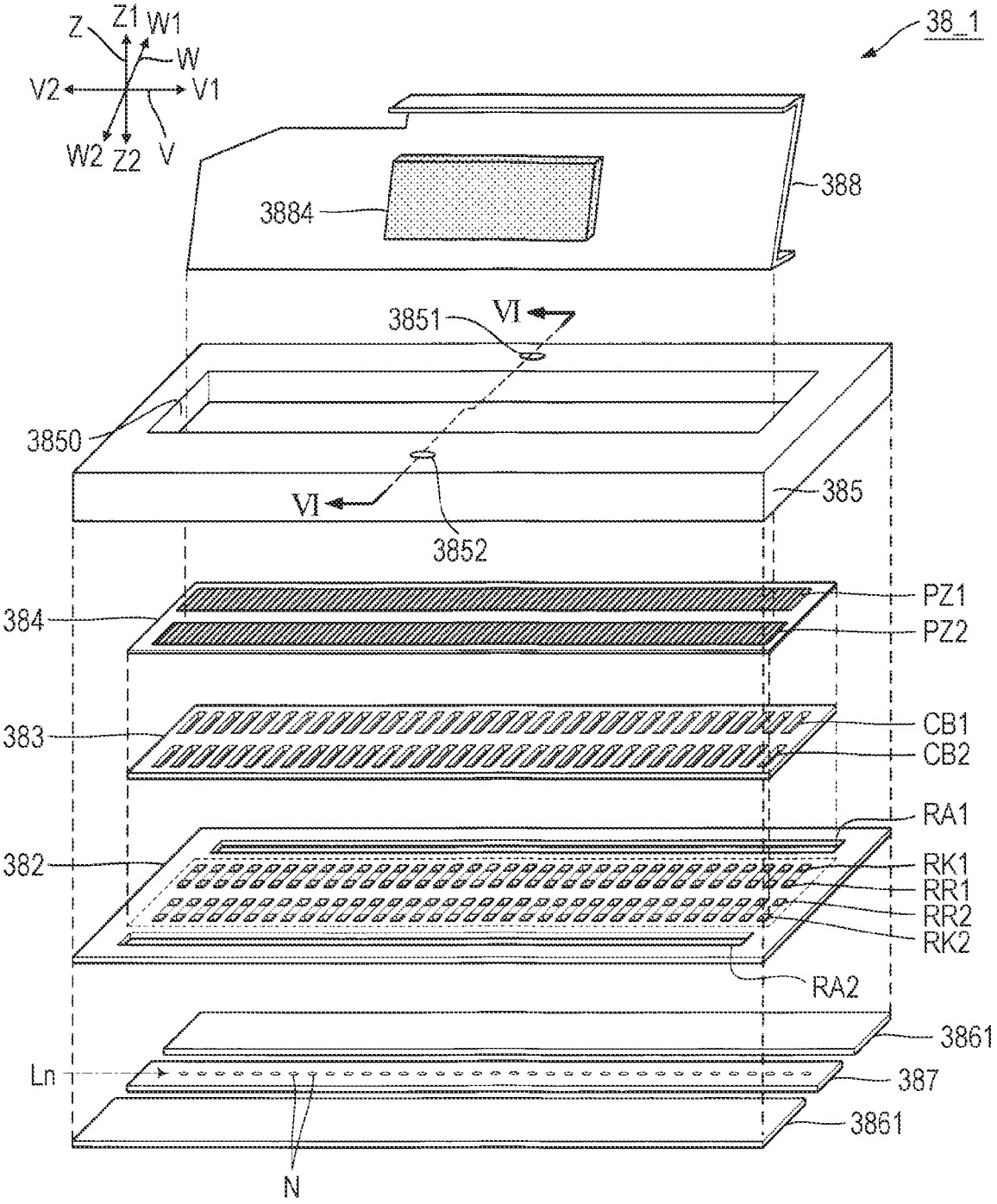
FIG. 5 is an exploded perspective view of a head chip.
Figure 6:
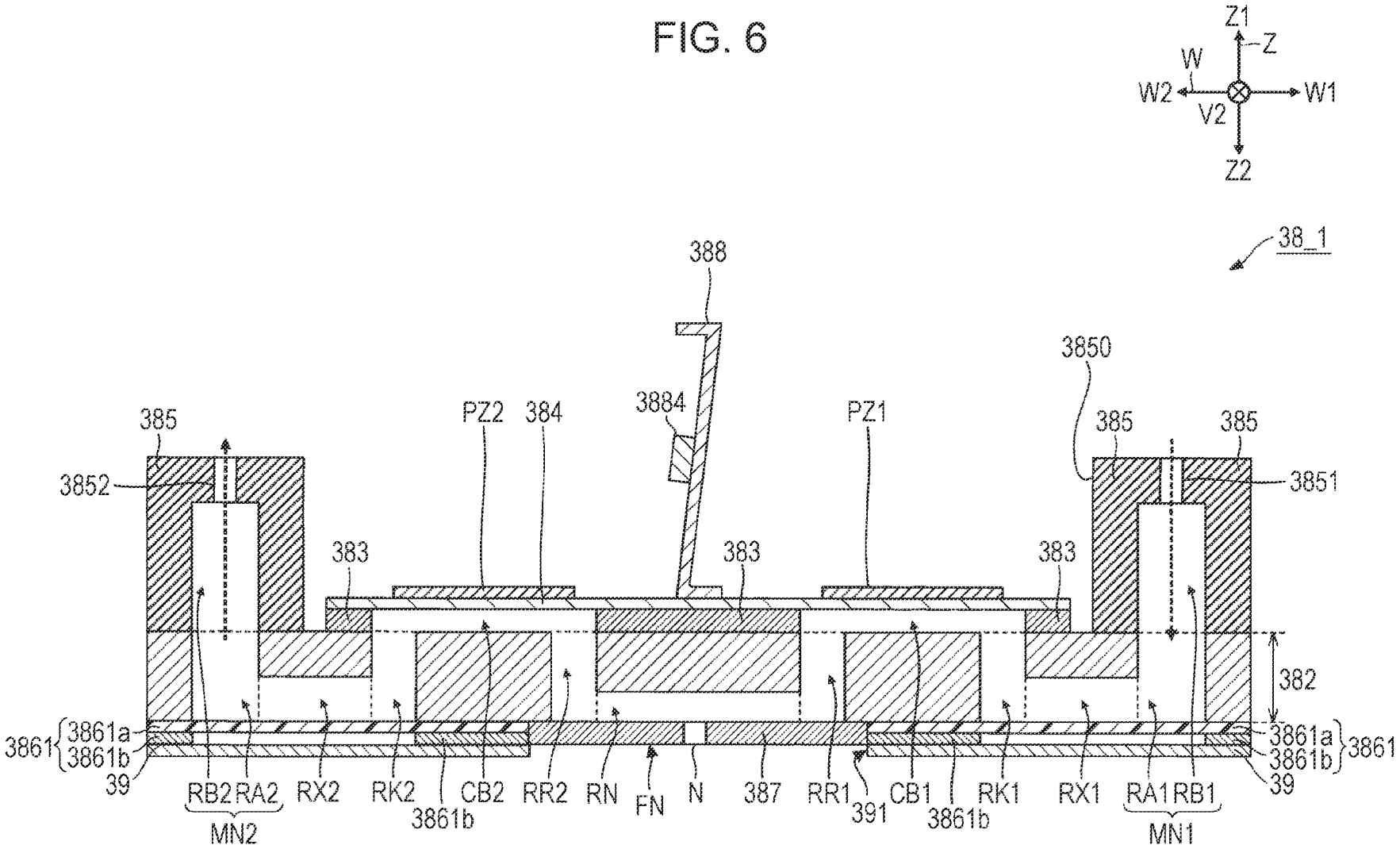
FIG. 6 is a cross-sectional view taken along line VI-VI in FIG. 5.

FIG. 5 is an exploded perspective view of the head chip 38_1. FIG. 6 is a cross-sectional view taken along the line VI-VI in FIG. 5. The VI-VI line is a virtual line segment that passes through an inlet 3851 and an outlet 3852 and passes through the nozzle N. In FIG. 6, in addition to the cross section of the head chip 38_1, the cross section of the fixing plate 39 is also shown.

As illustrated in FIGS. 5 and 6, the head chip 38_1 includes the nozzle plate 387, a compliance substrate 3861, a communication plate 382, a pressure chamber substrate 383, a vibration plate 384, a case 385, and the wiring member 388.

As illustrated in FIG. 5, the nozzle plate 387 is a plate-shaped member that is long in the V-axis direction and extends parallel to the VW plane, and M nozzles N are formed. The nozzle plate 387 is manufactured by processing a silicon single crystal substrate using, for example, a semiconductor manufacturing technique such as etching. However, any known material and manufacturing method can be employed for manufacturing the nozzle plate 387. Further, the nozzles N are a through-hole provided in the nozzle plate 387. In the present embodiment, as an example, it is assumed that M nozzles N are provided in the nozzle plate 387 so as to form a nozzle row Ln extending in the V-axis direction. However, the nozzle plate 387 may have a plurality of nozzle rows Ln in which some of M nozzles N are arranged in the V-axis direction.

As illustrated in FIGS. 5 and 6, the communication plate 382 is provided in the Z1 direction of the nozzle plate 387. The communication plate 382 is a plate-shaped member that is long in the V-axis direction and extends substantially parallel to the VW plane, and forms an ink flow path.

Specifically, one supply liquid chamber RA1 and one discharge liquid chamber RA2 are formed in the communication plate 382. Among them, the supply liquid chamber RA1 is provided so as to communicate with the supply liquid chamber RB1 to be described later and extend in the V-axis direction. Further, the discharge liquid chamber RA2 is provided so as to communicate with the discharge liquid chamber RB2 to be described later and extend in the V-axis direction. The supply liquid chamber RA1 may be divided into a plurality of parts in the V-axis direction, and the discharge liquid chamber RA2 may be also divided into a plurality of parts in the V-axis direction. Hereinafter, a common liquid chamber formed by the supply liquid chamber RA1 and the supply liquid chamber RB1 will be referred to as a "supply-side common liquid chamber MN1". Similarly, a common liquid chamber formed by the discharge liquid chamber RA2 and the discharge liquid chamber RB2 is referred to as "discharge-side common liquid chamber MN2".

Further, on the communication plate 382, M nozzle flow paths RN corresponding one-to-one with the M nozzles N, M communication flow paths RR1 corresponding to one-to-one with the M nozzles N, M communication flow paths RR2 corresponding one-to-one with the M nozzles N, M communication flow paths RK1 corresponding one-to-one with the M nozzles N, M communication flow paths RK2 corresponding one-to-one with the M nozzles N, M communication flow paths RX1 corresponding one-to-one with the M nozzles N, and M communication flow paths RX2 corresponding one-to-one with the M nozzles N are formed. On the communication plate 382, one communication flow path RX1 and communication flow path RX2 that are commonly provided in the M nozzles N may be formed. In this case, the communication flow path RX1 constitutes a part of the "supply-side common liquid chamber MN1", and the communication flow path RX2 constitutes a part of the "discharge-side common liquid chamber MN2". Further, a plurality of communication flow paths RX1 commonly provided for some nozzles N among the M nozzles N may be formed, or a plurality of communication flow paths RX2 commonly provided for some nozzles N among the M nozzles N may be formed.

As illustrated in FIG. 5, in the first embodiment, the communication flow path RX1 is provided to communicate with the supply liquid chamber RA1, be located in the W2 direction when viewed from the supply liquid chamber RA1, and extend in the W-axis direction. Further, the communication flow path RK1 is provided to communicate with the communication flow path RX1, be located in the W2 direction when viewed from the communication flow path RX1, and extend in the Z-axis direction. Further, the communication flow path RR1 is provided to be located in the W2 direction when viewed from the communication flow path RK1 and extend in the Z-axis direction.

Further, the communication flow path RX2 is provided to communicate with the discharge liquid chamber RA2, be located in the W1 direction when viewed from the discharge liquid chamber RA2, and extend in the W-axis direction. Further, the communication flow path RK2 is provided to communicate with the communication flow path RX2, be located in the W1 direction when viewed from the communication flow path RX2, and extend in the Z-axis direction. Further, the communication flow path RR2 is provided to be located in the W1 direction when viewed from the communication flow path RK2, be located in the W2 direction when viewed from the communication flow path RR1, and extend in the Z-axis direction.

Further, the nozzle flow path RN is provided to communicate with the communication flow path RR1 and the communication flow path RR2, be located in the W2 direction when viewed from the communication flow path RR1, be located in the W1 direction when viewed from the communication flow path RR2, and extend in the W-axis direction. The nozzle flow path RN communicates with the nozzle N corresponding to the nozzle flow path RN.

The communication plate 382 is manufactured, for example, by processing a silicon single crystal substrate using semiconductor manufacturing technique. However, any known material or manufacturing method can be employed for manufacturing the communication plate 382.

As illustrated in FIGS. 5 and 6, the pressure chamber substrate 383 is provided in the Z1 direction of the communication plate 382. The pressure chamber substrate 383 is a plate-shaped member that is long in the V-axis direction and extends substantially parallel to the VW plane, and forms an ink flow path.

Specifically, on the pressure chamber substrate 383, M pressure chambers CB1 corresponding to one-to-one with the M nozzles N and M pressure chambers CB2 corresponding to one-to-one with the M nozzles N are formed. Hereinafter, the pressure chamber CB1 and the pressure chamber CB2 are collectively referred to as a pressure chamber CB. The pressure chamber CB1 communicates with the communication flow path RK1 and the communication flow path RR1, and is provided to couple an end of the communication flow path RK1 in the W1 direction to an end of the communication flow path RR1 in the W2 direction when viewed in the Z-axis direction and extend in the W-axis direction. Further, the pressure chamber CB2 communicates with the communication flow path RK2 and the communication flow path RR2, and is provided to couple an end of the communication flow path RK2 in the W2 direction to an end of the communication flow path RR2 in the W1 direction when viewed in the Z-axis direction and extend in the W-axis direction. The number of pressure chambers CB provided corresponding to one nozzle N may be one, in other words, either one of the pressure chamber CB1 and the pressure chamber CB2 may be provided for one nozzle N.

The pressure chamber substrate 383 is manufactured, for example, by processing a silicon single crystal substrate using semiconductor manufacturing technique. However, any known material or manufacturing method can be employed for manufacturing the pressure chamber substrate 383.

As illustrated in FIGS. 5 and 6, the vibration plate 384 is provided in the Z1 direction of the pressure chamber substrate 383. The vibration plate 384 is a plate-shaped member that is long in the V-axis direction and extends substantially parallel to the VW plane, and is a member that can vibrate elastically. The vibration plate 384 may be formed of the same member as the pressure chamber substrate 383.

As illustrated in FIGS. 5 and 6, on the surface of the vibration plate 384 in the Z1 direction, M piezoelectric elements PZ1 corresponding to one-to-one with the M pressure chambers CB1 and M piezoelectric elements PZ2 corresponding to one-to-one with the M pressure chambers CB2 are provided. Hereinafter, the piezoelectric element PZ1 and the piezoelectric element PZ2 are collectively referred to as a piezoelectric element PZq. The piezoelectric element PZq is a passive element that be deformed in response to a change in the potential of the drive signal Com.

As illustrated in FIGS. 5 and 6, the wiring member 388 is mounted on the surface of the vibration plate 384 in the Z1 direction. The wiring member 388 is a component for electrically coupling the control device 90 and the head chip 38. As the wiring member 388, for example, a flexible wiring substrate such as FPC, COF, or FFC is preferably employed. Here, FPC is an abbreviation for Flexible Printed Circuit. COF is an abbreviation for Chip on Film. FFC is an abbreviation for Flexible Flat Cable. A drive circuit 3884 is mounted on the wiring member 388. The drive circuit 3884 is an electric circuit that switches whether or not to supply the drive signal Com to the piezoelectric element PZq under the control of the control signal SI.

The fixing plate 39 is adhered to the surface of the compliance substrate 3861 in the Z2 direction and the surface of the holder 37 in the Z2 direction. That is, six exposure openings 391 provided in the fixing plate 39 expose the nozzle surface FN of the nozzle plate 387 within the exposure openings 391. The nozzle surface FN is a surface on which a plurality of nozzles N are formed and faces the Z2 direction of the nozzle plate 387, and is a surface perpendicular to the Z2 direction. The six exposure openings 391 are also arranged in zigzags, similar to the openings 351 and the notches 352 of the wiring substrate 35.

As illustrated in FIG. 6, the compliance substrate 3861 has a flexible film 3861*a* and a support plate 3861*b*. The flexible film 3861*a* is a flexible member, and a film made of a resin such as PPS can be employed, and the support plate 3861*b* is a rigid member, and for example, stainless steel can be employed. PPS is an abbreviation for Poly Phenylene Sulfide. The flexible film 3861*a* is a member that covers the openings defining the supply liquid chamber RA1, the communication flow path RX1, the communication flow path RK1, the communication flow path RK2, the communication flow path RX2, and the discharge liquid chamber RA2 of the communication plate 382 in the Z2 direction by being fixed to the surface of the communication plate 382 in the Z2 direction. In other words, the flexible film 3861*a* is a member that defines the supply liquid chamber RA1, the communication flow path RX1, the communication flow path RK1, the communication flow path RK2, the communication flow path RX2, and the discharge liquid chamber RA2. The support plate 3861*b* is fixed to the surface of the flexible film 3861*a* in the Z2 direction, and has an opening formed at a position overlapping the supply liquid chamber RA1, the communication flow path RX1, the communication flow path RK1, the communication flow path RK2, the communication flow path RX2, and the discharge liquid chamber RA2, when viewed in the Z-axis direction. The fixing plate 39 is adhered to the support plate 3861*b* to seal the opening of the support plate 3861*b* in the Z2 direction. The space defined by the surface of the flexible film 3861*a* in the Z2 direction, the opening of the support plate 3861*b*, and the surface of the fixing plate 39 in the Z1 direction communicates with the atmosphere by an atmospheric communication passage (not shown), and the flexible film 3861*a* can absorb the pressure fluctuation generated in the head chips 38 by being deformed in the Z1 direction and the Z2 direction by the space.

As illustrated in FIGS. 5 and 6, the case 385 is provided in the Z1 direction of the communication plate 382. The case 385 is a member that is long in the V-axis direction, and an ink flow path is formed. Specifically, one supply liquid chamber RB1 and one discharge liquid chamber RB2 are formed in the case 385. Among them, the supply liquid chamber RB1 is provided to communicate with the supply liquid chamber RA1, be located in the Z1 direction when viewed from the supply liquid chamber RA1, and extend in the V-axis direction. Further, the discharge liquid chamber RB2 is provided to communicate with the discharge liquid chamber RA2, be located in the Z1 direction when viewed from the discharge liquid chamber RA2 and in the W2 direction when viewed from the supply liquid chamber RB1, and extend in the V-axis direction.

Further, in the case 385, the inlet 3851 that communicates with the supply liquid chamber RB1 and the outlet 3852 that communicates with the discharge liquid chamber RB2 are provided. Then, in the supply liquid chamber RB1, ink is supplied from the liquid container 93 via the inlet 3851 to the supply-side common liquid chamber MN1. The ink supplied to the supply-side common liquid chamber MN1 is stored in the discharge-side common liquid chamber MN2 via the flow path communicating with the nozzles N. The ink stored in the discharge-side common liquid chamber MN2 is collected via the outlet 3852.

Further, in the case 385, an opening 3850 is provided. Inside the opening 3850, the pressure chamber substrate 383, the vibration plate 384, and the wiring member 388 are provided. The case 385 is formed, for example, by injection molding of a resin material. However, any known material or manufacturing method can be employed for manufacturing the case 385.

Description will be made referring back to FIG. 4. Although the head chip 38_1 has been described with reference to FIGS. 5 and 6, the configuration of the head chips 38_2 to 38_6 is also the same as the configuration of the head chip 38_1. The wiring members 388 of the head chips 38_1 to 38_6 all have the same shape. The wiring members 388 of the head chips 38_2, 38_4, and 38_6 are arranged in a direction rotated by 180 degrees with respect to the direction of the wiring member 388 of the head chip 38_1 and the Z-axis direction as an axis.

1.3. Arrangement of Head Chip 38

As illustrated in FIG. 3, the plurality of head chips 38 are each arranged so as to extend in the V2 direction. The arrangement of the plurality of head chips 38 will be described in more detail with reference to FIG. 7.

Figure 7:
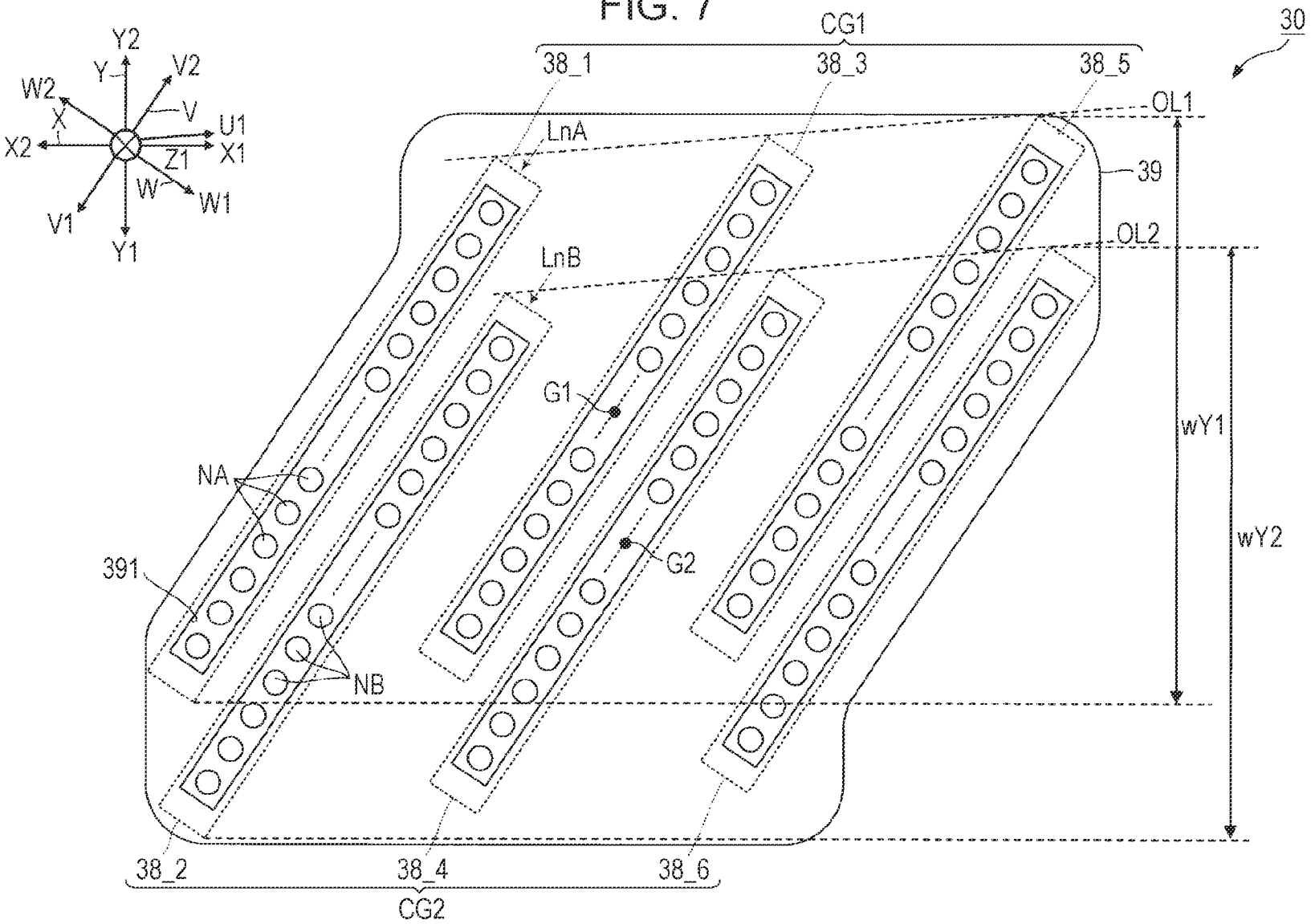
FIG. 7 is an explanatory view showing an arrangement relationship of a plurality of head chips.

FIG. 7 is an explanatory view showing the arrangement relationship of the plurality of head chips 38. The figure shown in FIG. 7 is a diagram of one liquid ejecting head 30 when viewed in the Z1 direction.

The plurality of head chips 38 included in one liquid ejecting head 30 have a first chip group CG1 and a second chip group CG2. The first chip group CG1 has head chips 38_1, 38_3, and 38_5. The second chip group CG2 has head chips 38_2, 38_4, and 38_6. For simplification of the description, the head chip 38 included in the first chip group CG1 are referred to as a "first head chip 38A", and the head chip 38 included in the second chip group CG2 is referred to as a "second head chip 38B". Further, the nozzle row Ln of the first head chip 38A is referred to as a "first nozzle row LnA", and the nozzle row Ln of the second head chip 38B is referred to as a "second nozzle row LnB". Further, the nozzles N constituting the first nozzle row LnA is referred to as "first nozzles NA", and the nozzles N constituting the second nozzle row LnB is referred to as "second nozzles NB".

The first ink is supplied to the first chip group CG1. The second ink is supplied to the second chip group CG2.

The plurality of first head chips 38A are arranged side by side in the X1 direction. Similarly, the plurality of second head chips 38B are arranged side by side in the X1 direction. The fact that the plurality of head chips 38 are arranged side by side in the X1 direction means that a part or all of the adjacent head chips 38 among the plurality of head chips 38 overlap each other when viewed in the X1 direction. In the first embodiment, for example, the head chips 38_1 and 38_3 partially overlap each other when viewed in the X1 direction.

The head chips 38_1, 38_3, and 38_5 are examples of "plurality of first head chips". The head chips 38_2, 38_4, and 38_6 are examples of "plurality of second head chips". The X1 direction is an example of the "second direction".

Further, among the plurality of first head chips 38A included in the second chip group CG2, adjacent head chips 38 partially overlap each other when viewed in the Y2 direction. Similarly, among the plurality of second head chips B included in the second chip group CG2, adjacent head chips 38 partially overlap each other when viewed in the Y2 direction. The Y2 direction is an example of the "third direction".

The first chip group CG1 is arranged side by side in the Y2 direction with respect to the second chip group CG2. The fact that the first chip group CG1 is arranged side by side in the Y2 direction with respect to the second chip group CG2 means that the center of gravity G1 of the first chip group CG1 and the center of gravity G2 of the second chip group CG2 are arranged side by side in the Y2 direction when viewed in the X1 direction perpendicular to the Y2 direction. The center of gravity refers to a point where the sum of the first moments of the cross section becomes zero in a target shape, and in the case of a rectangular shape, it refers to the intersection of diagonal lines. In the first embodiment, the center of gravity G1 is at a position overlapping the head chip 38_3. The center of gravity G2 is at a position of overlapping the head chip 38_4.

Further, the first chip group CG1 and the second chip group CG2 substantially overlap each other when viewed in the Y2 direction. The fact that the first chip group CG1 and the second chip group CG2 substantially overlap each other when viewed in the Y2 direction means that, when viewed in the Y2 direction, the head chip 38_5 disposed foremost position in the X1 direction among the plurality of first head chips 38A and the head chip 38_6 disposed foremost in the X1 direction among the plurality of second head chips 38B are substantially overlapped with each other, and the head chip 38_1 disposed foremost in the X2 direction among the plurality of first head chips 38A and the head chip 38_2 disposed foremost in the X2 direction among the plurality of second head chips 38B are overlapped to each other. In other words, the fact that the first chip group CG1 and the second chip group CG2 substantially overlap each other when viewed in the Y2 direction means that the head chip 38_5 disposed foremost in the X1 direction among the plurality of first head chips 38A and the head chip 38_6 disposed foremost in the X1 direction among the plurality of second head chips 38B are substantially at the same position with respect to the X-axis direction, and the head chip 38_1 disposed foremost in the X2 direction among the plurality of first head chips 38A and the head chip 38_2 disposed foremost in the X2 direction among the plurality of second head chips 38B are substantially at the same position with respect to the X-axis direction. Further, the fact that the two head chips 38 are substantially at the same position with respect to the X-axis direction means that, for example, the first nozzle NA disposed foremost in the X1 direction in the head chip 38_5 disposed foremost in the X1 direction among the plurality of first head chips 38A and the second nozzle NB disposed in the X1 direction in the head chip 38_6 disposed foremost in the X1 direction among the plurality of second head chips 38B are at the same position with respect to the X-axis direction, or the relative distance of the head chips 38 mentioned above with respect to the X-axis direction is half or less of an interval dx1 in the X-axis direction between nozzles N in the second nozzle row LnB that are adjacent to each other, which will be described later.

Further, the first chip group CG1 and the second chip group CG2 partially overlap each other when viewed in the X1 direction. Specifically, as illustrated in FIG. 7, in the Y-axis direction, there is an overlap portion between the width wY1 from the end of the first chip group CG1 in the Y2 direction to the end of the first chip group CG1 in the Y1 direction and the width wY2 from the end of the second chip group CG2 in the Y2 direction to the end of the second chip group CG2 in the Y1 direction.

Further, the plurality of first head chips 38A and the plurality of second head chips 38B are alternately adjacent to each other along the X axis. In other words, one first head chip 38A of the plurality of first head chips 38A and one second head chip 38B of the plurality of second head chips 38B are adjacent to each other along the X axis. Specifically, the head chip 38_1, which is one of the plurality of first head chips 38A, and the head chip 38_2, which is one of the plurality of second head chips 38B, are adjacent to each other along the X axis. Similarly, the head chip 38_3 and the head chip 38_4 are adjacent to each other along the X axis. Further, the head chip 38_5 and the head chip 38_6 are adjacent to each other along the X axis.

The fact that the plurality of first head chips 38A and the plurality of second head chips 38B are alternately adjacent to each other in the X-axis direction may be stated in other words; that is, the plurality of first head chips 38A and the plurality of second head chips 38B are arranged in zigzags. More specifically, the head chips 38_1, 38_2, 38_3, 38_4, 38_5, and 38_6 are arranged in this order in the X-axis direction. In other words, one second head chip 38Bα of the plurality of second head chips 38B is located next to one first head chip Aα of one of the plurality of first head chips 38A, and is located in the X1 direction with respect to the first head chip Aα. Further, the second head chip 38Bα is located next to one first head chip 38Aβ that is different from the first head chip 38Aα, among the plurality of first head chips 38A, and is located in the X2 direction opposite to the X1 direction with respect to the first head chip 38Aβ. In the above description, when one target second head chip 38Bα among the plurality of second head chips 38B is, for example, the head chip 38_2, the head chip 38_1 is an example of the "first head chip α", and the head chip 38_3 is an example of the "first head chip β".

Further, each of the head chips 38_1 to 38_6 is arranged along any one of a virtual straight line OL1 and a virtual straight line OL2 parallel to the virtual straight line OL1. The virtual straight line OL1 and the virtual straight line OL2 are straight lines in a U1 direction that is orthogonal to the Z-axis direction and intersects both the X-axis direction and the Y-axis direction. The plurality of first head chips 38A are arranged along the virtual straight line OL1. The U1 direction is the direction between the X1 direction and the Y2 direction. Therefore, in two adjacent first head chips 38A among the plurality of first head chips 38A, one first head chip 38A disposed in the X1 direction is disposed offset from the other first head chip 38A in the Y2 direction. For example, in the head chips 38_1 and 38_3, the head chip 38_3 disposed in the X1 direction is disposed offset from the head chip 38_1 in the Y2 direction. Similarly, in the head chips 38_3 and 38_5, the head chip 38_5 disposed in the X1 direction is disposed offset from the head chip 38_3 in the Y2 direction.

The plurality of second head chips 38B are arranged along the virtual straight line OL2. Therefore, in two adjacent second head chips 38B among the plurality of second head chips 38B, one second head chip 38B disposed in the X1 direction is disposed offset from the other second head chip 38B in the Y2 direction. For example, of the head chips 38_2 and 38_4, the head chip 38_4 disposed in the X1 direction is disposed offset from the head chip 38_2 in the Y2 direction. Similarly, of the head chips 38_4 and 38_6, the head chip 38_6 disposed in the X1 direction is disposed offset from the head chip 38_4 in the Y2 direction.

In other words, "the plurality of head chips 38 are arranged along the virtual straight line" means that the end portions of the plurality of head chips 38 in the V2 direction are arranged side by side to overlap the virtual straight line in the plan view in the Z1 direction. Hereinafter, the plan view in the Z1 direction is simply referred to as "plan view". "A plurality of head chips 38 are arranged along a virtual straight line" may mean that the end portions of the plurality of head chips 38 in the V1 direction are arranged side by side to overlap the virtual straight line in a plan view in the Z1 direction, or may mean that the centers of the plurality of head chips 38 in the V-axis direction are arranged side by side to overlap the virtual straight line in the plan view.

When viewed in the Y2 direction, the first chip group CG1 and the second chip group CG2 are described as substantially overlapping each other when viewed in the Y2 direction. Here, a specific degree of overlap between the first head chip 38A and the second head chip 38B will be described with reference to FIG. 8.

Figure 8:
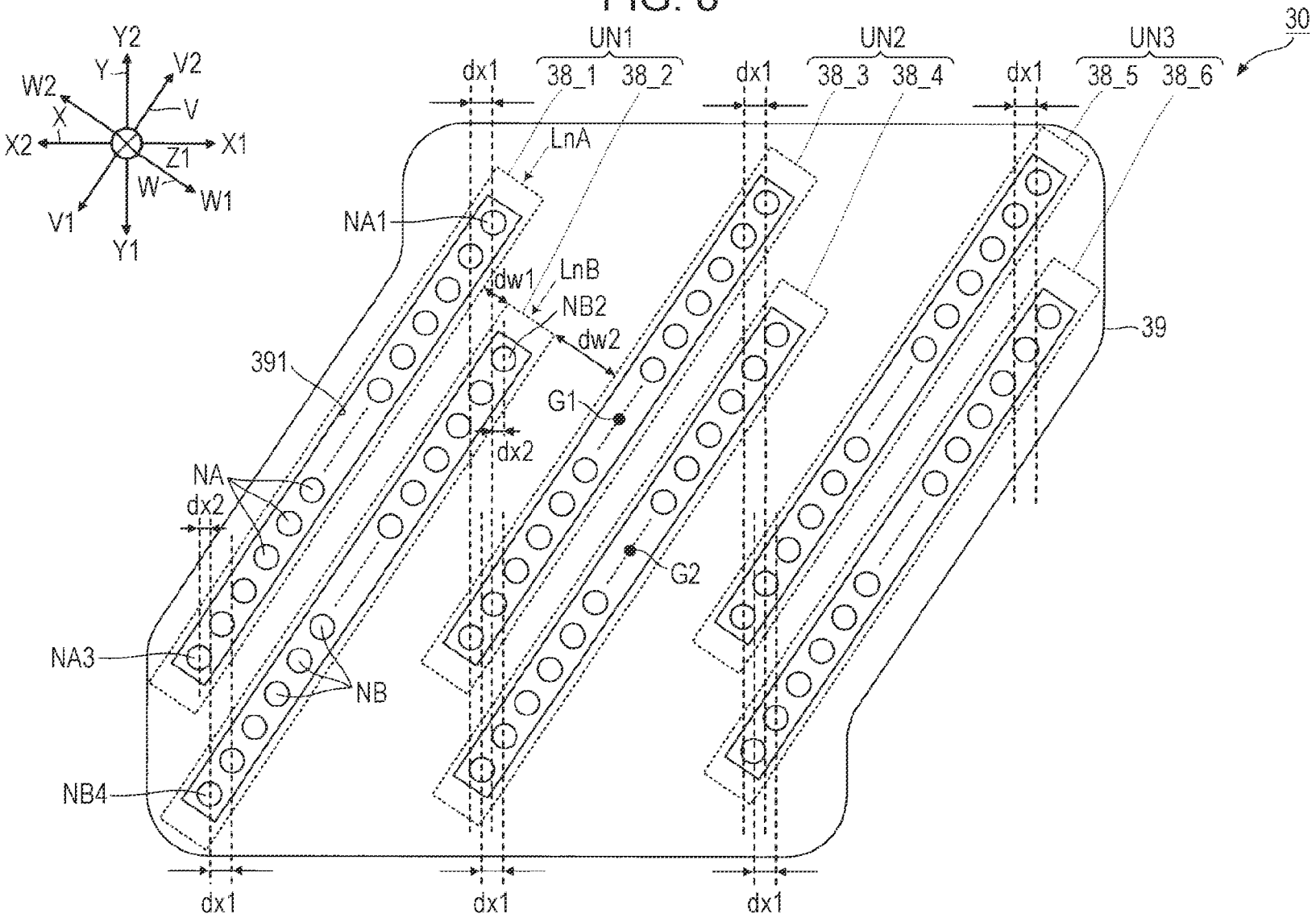
FIG. 8 is an explanatory view showing a degree of overlap of the plurality of head chips.

FIG. 8 is an explanatory view showing the degree of overlap of the plurality of head chips 38. The first chip group CG1 and the second chip group CG2 have a plurality of sets UN including the first head chip 38A and the second head chip 38B adjacent to each other along the Y axis. In the same set UN of the plurality of sets UN, the first head chip 38A is located next to the second head chip 38B and is located in the Y2 direction with respect to the second head chip 38B. Specifically, the first chip group CG1 and the second chip group CG2 have a set UN1 including the head chip 38_1 and the head chip 38_2, a set UN2 including the head chip 38_3 and the head chip 38_4, and a set UN3 including the head chip 38_5 and the head chip 38_6. In the following description, the set UN is a general term for the set UN1, the set UN2, and the set UN3. In the first embodiment, the first chip group CG1 and the second chip group CG2 have three sets of UNs, but may have two sets of UNs, or may have four or more sets of UNs.

As illustrated in FIG. 8, the interval in the X1 direction between the nozzles N adjacent to each other in the nozzle row Ln is a first length dx1. In the first nozzle row LnA and the second nozzle row LnB included in any one set UNx of the set UN1, the set UN2, and the set UN3, a first interval in the X1 direction between the center of the first nozzle NA positioned foremost in the V2 direction in the first nozzle row LnA and the center of the second nozzle NB positioned foremost in the V2 direction in the second nozzle row LnB is less than or equal to a second length dx2. In the present embodiment, x is an integer 1 to 3. The second length dx2 is half of the first length dx1. In the first embodiment, the first interval is the second length dx2. For example, the first interval between the center of the first nozzle NA1 positioned foremost in the V2 direction in the first nozzle row LnA included in the set UN1 and the center of the second nozzle NB2 disposed foremost in the V2 direction in the second nozzle row LnB included in the set UN1 is the second length dx2.

Further, In the first nozzle row LnA and the second nozzle row LnB included in the set UNx, a second interval in the X1 direction between the center of the first nozzle NA positioned foremost in the V1 direction in the first nozzle row LnA and the center of the second nozzle NB positioned foremost in the V1 direction in the second nozzle row LnB is less than or equal to the second length dx2. In the first embodiment, the first interval is the second length dx2. For example, a first interval between the center of the first nozzle NA3 positioned foremost in the V2 direction in the first nozzle row LnA included in the set UN1, and the center of the second nozzle NB4 positioned foremost in the V2 direction in the second nozzle row LnB included in the set UN1 is the second length dx2.

In the first embodiment, the first nozzle NA1 is located in the X2 direction with respect to the second nozzle NB2. However, the first nozzle NA1 may be located in the X1 direction with respect to the second nozzle NB2. Further, in the example of FIG. 8, in the two adjacent first head chips 38A along the X axis, the number of first nozzles NA overlapped when viewed in the Y-axis direction is four in total of the two first head chips 38A, where there are two in one first head chip 38A, but one or more may be sufficient. Similarly, in the two adjacent second head chips 38B along the X axis, the number of second nozzles NB overlapped when viewed in the Y-axis direction is four in total of the two second head chips 38B, where there are two in one second head chip 38B, but one or more may be sufficient. Hereinafter, a region in which the overlapping nozzles N are arranged when viewed in the Y-axis direction is referred to as a "nozzle overlap region".

In the two nozzles N included in the nozzle overlap region and overlapped when viewed in the Y-axis direction, one nozzle N may eject ink. For example, the control device 90 ejects ink from the nozzle N in which the ejection failure does not occur among the two nozzles N arranged in the nozzle overlap region. Ejection failure of the nozzle N occurs due to an increase in ink viscosity, mixing of air bubbles, and the like. The control device 90 performs at least one of a method for determining whether or not ejection failure occurs based on image information obtained by reading a printed image formed on the medium PP, a method for determining whether or not ejection failure occurs based on a waveform of a residual vibration of the vibration plate 384, and the like.

Regarding the distance of the head chips 38 in the W-axis direction, the first distance in the W1 direction between the first head chip 38A and the second head chip 38B included in the set UNx of the plurality of sets UN is shorter than the distance in the W1 direction between the head chip 38 disposed closest to a set UNy adjacent to the set UNx among the plurality of head chips 38 included in the set UNx and the head chip 38 disposed closest to a first set among the plurality of head chips 38 included in a second set. As described above, x is an integer from 1 to 3. y is an integer from 1 to 3, of which the difference from x is 1. Using the example in which x is 1 and y is 2, as illustrated in FIG. 8, the first distance in the W1 direction between the head chip 38_1 and the head chip 38_2 included in the set UN1 is a length dw1, and the second distance in the W1 direction between the head chip 38_2 and the head chip 38_3 is a length dw2. The length dw1 is shorter than the length dw2. When the set UNx is an example of the "first set", the set UNy is an example of the "second set". More specifically, when the set UN1 is an example of the "first set", the set UN2 is an example of the "second set".

1.4. Summary of First Embodiment

As described above, the liquid ejecting head 30 in the first embodiment includes the plurality of head chips 38 that eject the liquid toward the medium PP in the Z2 direction. The Z2 direction is an example of the "first direction". The plurality of head chips 38 have the first chip group CG1 and the second chip group CG2. In the first chip group CG1, the plurality of first head chips 38A having the first nozzle row LnA including a plurality of first nozzles NA arranged side by side in the V2 direction are arranged side by side in the X1 direction. In the second chip group CG2, the plurality of second head chips 38B having the second nozzle row LnB including of a plurality of second nozzles NB arranged side by side in the V2 direction are arranged side by side in the X1 direction. The first chip group CG1 is arranged side by side in the Y2 direction with respect to the second chip group CG2. The X1 direction is an example of the "second direction". The X1 direction is the width direction of the medium PP. The Y2 direction is an example of the "third direction". The Y2 direction is the direction orthogonal to the X1 direction. The V2 direction is an example of the "fourth direction". The V2 direction is the direction perpendicular to the Z2 direction and intersecting the X1 direction and the Y2 direction.

In a mode in which the first chip group CG1 and the second chip group CG2 are fixed to different fixing plates 39, in other words, in a mode in which the liquid ejecting head having the first chip group CG1 and the liquid ejecting head having the second chip group CG2 are different, print quality may deteriorate due to the misalignment between the two liquid ejecting heads. In order to suppress deterioration of print quality, the position of the liquid ejecting head is adjusted by the head fixing substrate for fixing the liquid ejecting head; however, when the scale of the liquid ejecting apparatus is large, the number of liquid ejecting heads is large, and thus there is a limitation in that adjusting the position all liquid ejecting heads takes a lot of time.

On the other hand, according to the first embodiment, since the first chip group CG1 and the second chip group CG2 are fixed to the single fixing plate 39 and the single holder 37, the positioning accuracy of the nozzles N between the plurality of head chips 38 included in one liquid ejecting head can be improved as compared with the mode in which the first chip group CG1 and the second chip group CG2 are fixed to different fixing plates 39. By improving the positioning accuracy of the nozzles N, deterioration of print quality can be suppressed. Specifically, when the first ink and the second ink are inks of the same color, by arranging the first chip group CG1 and the second chip group CG2 at appropriate positions, high resolution can be achieved while suppressing deterioration of print quality. For example, when a single unit resolution is 600 dpi, the liquid ejecting head 30 can achieve 1200 dpi, which is twice as much as 600 dpi. Further, when the first ink and the second ink are inks of different colors, it is possible to print in multiple colors while suppressing deterioration of print quality.

Further, at the end portion of the liquid ejecting head 30 in the X1 direction and the end portion thereof in the X2 direction, the nozzle overlap region is generated between two adjacent liquid ejecting heads 30 along the X axis. However, the control device 90 prints on the medium PP by using the respective nozzles N included in the nozzle overlap region generated between the two liquid ejecting heads 30, and then determine the nozzle N to use based on the printed image formed on the medium. As a result, the control device 90 can suppress the landing deviation to half or less of the first length dx1 which is the interval between the nozzles N adjacent to each other of the nozzle row Ln in the X1 direction.

By achieving high resolution, the size of dots formed by one droplet in the medium PP becomes small. By reducing the size of the dots, the region that can be filled can be reduced, that is, the so-called solid quality can be improved. Further, by reducing the size of the dots, graininess, so-called fineness, can be improved. Further, by reducing the size of the dots, the ratio of the surface area of the ink to the volume of the ink becomes larger. By increasing the ratio of the surface area of the ink to the volume of the ink, the drying speed of the ink can be improved. In addition, by increasing the resolution and reducing the dot size, the character quality can be improved.

Further, the first chip group CG1 and the second chip group CG2 partially overlap each other when viewed in the X1 direction.

According to the first embodiment, the size of the liquid ejecting head 30 in the Y-axis direction can be reduced as compared with the mode in which the first chip group CG1 and the second chip group CG2 do not overlap when viewed in the X1 direction. Further, according to the first embodiment, the landing accuracy of the droplets ejected from the nozzles N can be improved, and print quality can be improved.

The reason why the landing accuracy is improved in the first embodiment will be described. As described above, the medium PP is transported in the Y1 direction, but when the medium PP is supplied to the liquid ejecting apparatus 100 while being inclined with respect to the Y1 direction, the medium PP may be transported with inclination to the Y1 direction. When the medium PP is transported with inclination with respect to the Y1 direction, as the distance in the Y-axis direction between the first chip group CG1 and the second chip group CG2 increases, the deviation of the landing position of the droplet ejected from the second nozzle NB included in the second chip group CG2 becomes large. Giving a description using the first nozzle NA1 and the second nozzle NB2 illustrated in FIG. 8, the deviation is the distance in the X-axis direction from the position where the droplet ejected from the second nozzle NB2 actually lands to the position where the droplet ejected from the second nozzle NB2 has to land. In the example of the first embodiment, the position where the droplet ejected from the second nozzle NB2 has to land is the position moved by the second length dx2 in the X1 direction from the position of landing of the droplet ejected from the first nozzle NA1 in the X-axis direction. In the first embodiment, since the first chip group CG1 and the second chip group CG2 partially overlap each other when viewed in the X1 direction, the distance in the Y-axis direction between the first chip group CG1 and the second chip group CG2 becomes short as compared with the mode in which the first chip group CG1 and the second chip group CG2 do not overlap each other when viewed in the X1 direction. Therefore, in the first embodiment, the deviation of the landing position of the droplets ejected from the second nozzle NB included in the second chip group CG2 is small as compared to the deviation in the mode in which the first chip group CG1 and the second chip group CG2 do not overlap each other when viewed in the X1 direction. Therefore, according to the first embodiment, the landing accuracy of the droplets ejected from the nozzles N can be improved even when the medium PP is transported with inclination with respect to the Y1 direction.

The first chip group CG1 and the second chip group CG2 have a plurality of sets UN including the first head chip 38A and the second head chip 38B adjacent to each other along the Y axis. The interval in the X1 direction between the centers of the first nozzles NA adjacent to each other in the first nozzle row LnA is the first length dx1. The interval in the X1 direction between the centers of the second nozzle NBs adjacent to each other in the second nozzle row LnB is the first length dx1. Among the plurality of sets UN, in the first nozzle row LnA and the second nozzle row LnB included in any one set UNx, the first interval less than or equal to the second length dx2, which is half of the first length dx1, and the second interval is the second length dx2 or less. The first interval is the interval in the X1 direction between the center of the first nozzle NA positioned foremost in the V2 direction in the first nozzle row LnA and the center of the second nozzle NB positioned foremost in the V2 direction in the second nozzle row LnB. The second interval is the interval in the X1 direction between the center of the first nozzle NA positioned foremost in the V1 direction in the first nozzle row LnA and the center of the second nozzle NB positioned foremost in the V1 direction is the second nozzle row LnB, and the second interval is less than or equal to the second length. The V1 direction is opposite to the V2 direction.

It can be said that the first length dx1 is the interval in the X-axis direction between adjacent nozzles N in one head chip 38, and the second length dx2 is the interval in the X-axis direction between the first nozzle NA included in the first head chip 38A and the second nozzle NB included in the second head chip 38B, which are included in one set UN. In the mode in which the second length dx2 is longer than the first length dx1, in the X-axis direction, there are parts where a high resolution can be achieved and parts that a high resolution cannot be achieved, and when printing at the high resolution, the nozzles N in the parts where the high resolution cannot be achieved are made useless. Useless nozzles N will be described by showing a reference example in FIG. 9, where the first chip group CG1 and the second chip group CG2 match in the Y2 direction.

Figure 9:
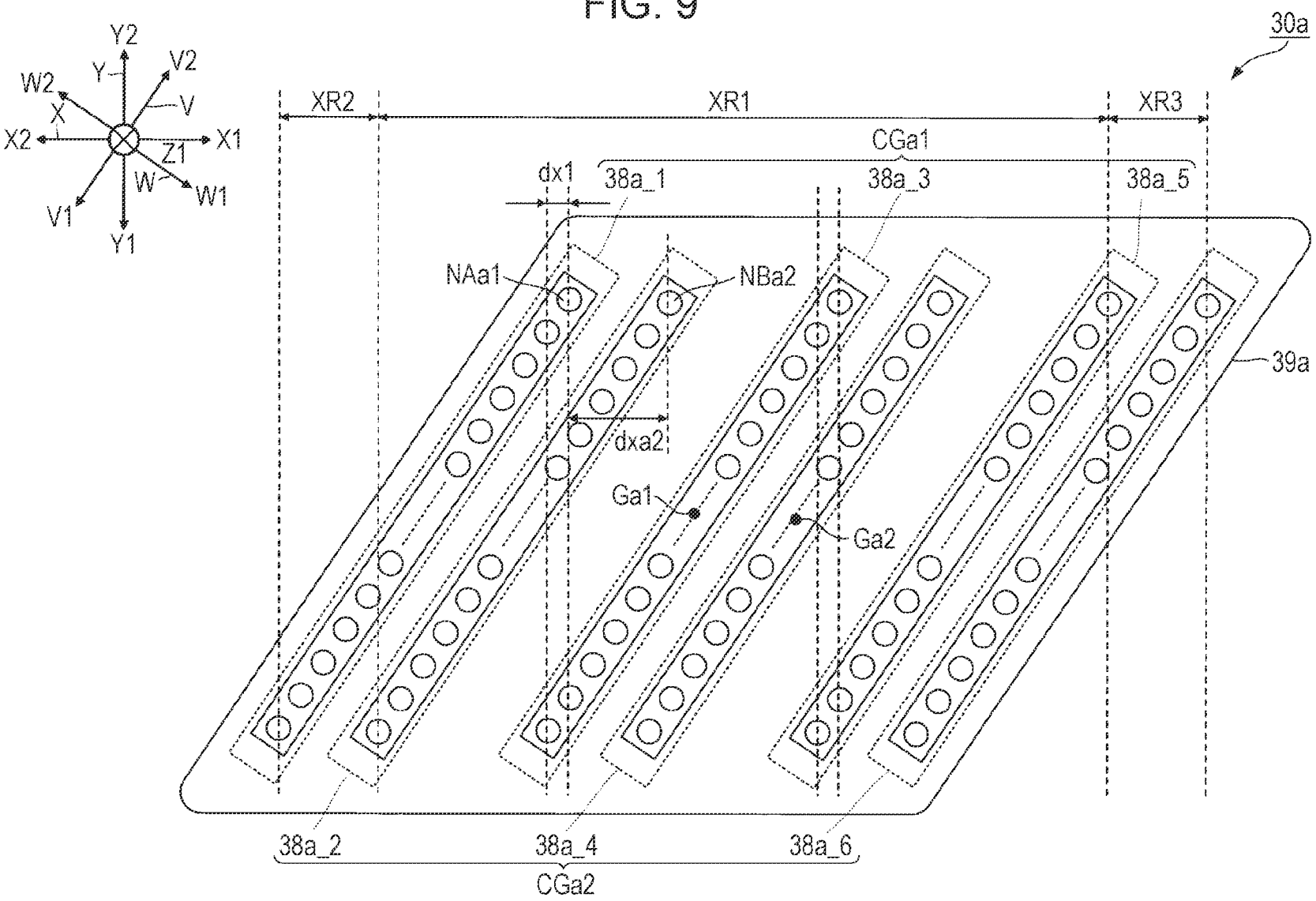
FIG. 9 is a diagram of a liquid ejecting head as a reference example when viewed in the Z1 direction.

FIG. 9 is a view of the liquid ejecting head 30*a* of the reference example when viewed in the Z1 direction. The liquid ejecting head 30*a* has a fixing plate 39*a* and a plurality of head chips 38*a*. The shape of the fixing plate 39*a* is different from that of the first embodiment in that it is a substantially parallelogram in a plan view. The head chip 38*a* has the same configuration as the head chip 38, but differs from the first embodiment in that the arrangement position of the fixing plate 39*a* is different. The plurality of head chips 38*a* have a first chip group CGa1 and a second chip group CGa2. The first chip group CGa1 has head chips 38*a*_1, 38*a*_3, and 38*a*_5. The second chip group CGa2 has head chips 38*a*_2, 38*a*_4, and 38*a*_6. When viewed in the X1 direction, the center of gravity Gal of the first chip group CGa1 and the center of gravity Gat of the second chip group CGa2 overlap each other. That is, the first chip group CGa1 is not arranged side by side in the Y2 direction with respect to the second chip group CGa2.

In the reference example, a first interval in the X1 direction between the center of a first nozzle NAa1 positioned foremost in the V2 direction in a first nozzle row LnA included in the head chip 38*a*_1 and the center of a second nozzle NBa2 positioned foremost in the V2 direction in a second nozzle row LnB included in the head chip 38*a*_2 is a length dxa2. The length dxa2 is longer than the length dx1. Therefore, when the ink of the same color is used for the first ink to be ejected from the first chip group CGa1 and the second ink to be ejected from the second chip group CGa2, in the X-axis direction, a part XR1 that can achieve higher resolution than single unit resolution and a part XR2 and a part XR3 corresponding to single unit resolution, which cannot achieve high resolution are generated. For example, when one head chip 38 implements 600 dpi, the part XR1 can achieve 1200 dpi, but the part XR2 and the part XR3 can achieve only up to 600 dpi. Further, when the first ink to be ejected from the first chip group CGa1 and the second ink to be ejected from the second chip group CGa2 use inks of different colors from each other, in the X-axis direction, the part XR1 that can achieve multi-color (two colors in the present embodiment) printing and parts XR2 and XR3 that cannot achieve multi-color (two colors in the present embodiment) printing are generated. As described above, for high-resolution printing or multi-color printing, the nozzles N corresponding to the parts XR2 and XR3 cannot be used, which makes the nozzles useless. However, assuming that the liquid ejecting head 30*a* illustrated in FIG. 9 is the first liquid ejecting head 30*a*, by the second liquid ejecting head 30*a* located next to the first liquid ejecting head 30*a* and located in the X2 direction with respect to the first liquid ejecting head 30*a*, the part XR2 of the first liquid ejecting head 30*a* can have high resolution and support multiple colors, in the reference example, two colors. Similarly, by the third liquid ejecting head 30*a* located next to the first liquid ejecting head 30*a* and located in the X1 direction with respect to the first liquid ejecting head 30*a*, the part XR3 of the first liquid ejecting head 30*a* can have high resolution and support multiple colors, in the reference example, two colors. However, in order to increase the resolution of the part XR2 and the part XR3 of the first liquid ejecting head 30*a* or to support multiple colors, the second liquid ejecting head 30*a* and the third liquid ejecting head 30*a* located next to the first liquid ejecting head 30*a* have to be accurately arranged.

Therefore, according to the first embodiment, by setting the second length dx2 to the first length dx1 or less, it is possible to suppress the generation of the part where high resolution and multi-color support cannot be achieved. When the first ink and the second ink are inks of the same color, it is possible to achieve high resolution while suppressing deterioration of print quality. Even when the first ink and the second ink are inks of different colors, it is possible to print in multiple colors while suppressing deterioration of print quality. Further, as illustrated in FIG. 9, the part XR2 is located at the end portion of the liquid ejecting head 30*a* in the X2 direction, and the part XR3 is located at the end portion of the liquid ejecting head 30*a* in the X1 direction. Therefore, in the reference example, when printing with high resolution by using the same color ink for the first ink to be ejected from the first chip group CGa1 and the second ink to be ejected from the second chip group CGa2, or when printing in two colors, with the resolution corresponding to each color being a single unit resolution, by using inks of different colors for the first ink to be ejected from the first chip group CGa1 and the second ink to be ejected from the second chip group CGa2, the printable width in the X-axis direction becomes short compared to when printing, where the resolution is a single unit resolution, by using the same color ink for the first ink to be ejected from the first chip group CGa1 and the second ink to be ejected from the second chip group CGA2. Further, it is also possible to arrange the plurality of liquid ejecting heads 30 side by side in the X-axis direction such that printing can be performed up to the end of the medium PP in the X-axis direction. In this case, the liquid ejecting apparatus 100 becomes large in the X-axis direction. On the other hand, according to the first embodiment, when printing with high resolution by using the same color ink for the first ink to be ejected from the first chip group CG1 and the second ink to be ejected from the second chip group CG2, or even when printing in two colors, with the resolution corresponding to each color being a single unit resolution, by using inks of different colors for the first ink to be ejected from the first chip group CG1 and the second ink to be ejected from the second chip group CG2, the printable width in the X-axis direction can be maintained as compared to when printing with a single unit resolution by using the same color ink for the first ink to be ejected from the first chip group CG1 and the second ink to be ejected from the second chip group CG2.

Further, in the first embodiment, the first interval and the second interval are the second length dx2. When the first ink and the second ink are inks of the same color, since the first interval and the second interval are the second length dx2, it is possible to achieve a resolution twice the resolution implemented by one head chip 38. However, as described above, the first ink and the second ink may be inks of different colors.

Further, in the first embodiment, a first distance in the W1 direction between the first head chip 38A and the second head chip 38B included in the set UNx of the plurality of sets UN is shorter than a second distance in the W1 direction between the head chip 38 disposed closest to a set UNy adjacent to the set UNx among the plurality of head chips 38 included in the set UNx and the head chip 38 disposed closest to the set UNx among the plurality of head chips 38 included in the set UNy. The W1 direction is an example of the "fifth direction". The W1 direction is a direction perpendicular to the Z2 direction and orthogonal to the V1 direction. The set UNx is an example of the "first set", and the set UNy is an example of the "second set".

The first distance is, in other words, the interval in the W1 direction between the head chips 38 in one set, and the second distance is the interval in the W1 direction between the head chips 38 in the adjacent sets UN. By shortening the interval in the W1 direction between the head chips 38 in one set, the distance in the Y-axis direction between the first chip group CG1 and the second chip group CG2 becomes shorter. Therefore, according to the first embodiment, the landing accuracy of the droplets ejected from the nozzles N can be improved as compared with the mode in which the first distance is equal to or greater than the second distance, even when the medium PP is transported with inclination with respect to the Y1 direction.

Further, in the first embodiment, in two adjacent first head chips 38A among the plurality of first head chips 38A, one first head chip 38A disposed in the X1 direction is disposed offset from the other first head chip 38A in the Y2 direction. In two adjacent second head chips 38B among the plurality of second head chips 38B, one second head chip 38B disposed in the X1 direction is disposed offset from the other second head chip 38B in the Y2 direction. The V2 direction is the direction between the X1 direction and the Y2 direction.

According to the first embodiment, when the plurality of liquid ejecting heads 30 are arranged side by side in the X-axis direction, the distance between the plurality of liquid ejecting heads 30 can be increased while maintaining the number of nozzles N included in the nozzle overlap region between the liquid ejecting heads 30 as compared with the mode in which the plurality of first head chips 38A are arranged side by side in the X-axis direction. By increasing the distance between the plurality of liquid ejecting heads 30, the vacant space can be effectively utilized. For example, the holder 37 can be thickened to fill the vacant space. Alternatively, the ink flow path may be disposed to fill the vacant space.

2. SECOND EMBODIMENT

In the first embodiment, the first interval and the second interval have the second length dx2, but in a second embodiment, the first interval and the second interval are 0, which is different from the first embodiment. Hereinafter, the second embodiment will be described.

Figure 10:
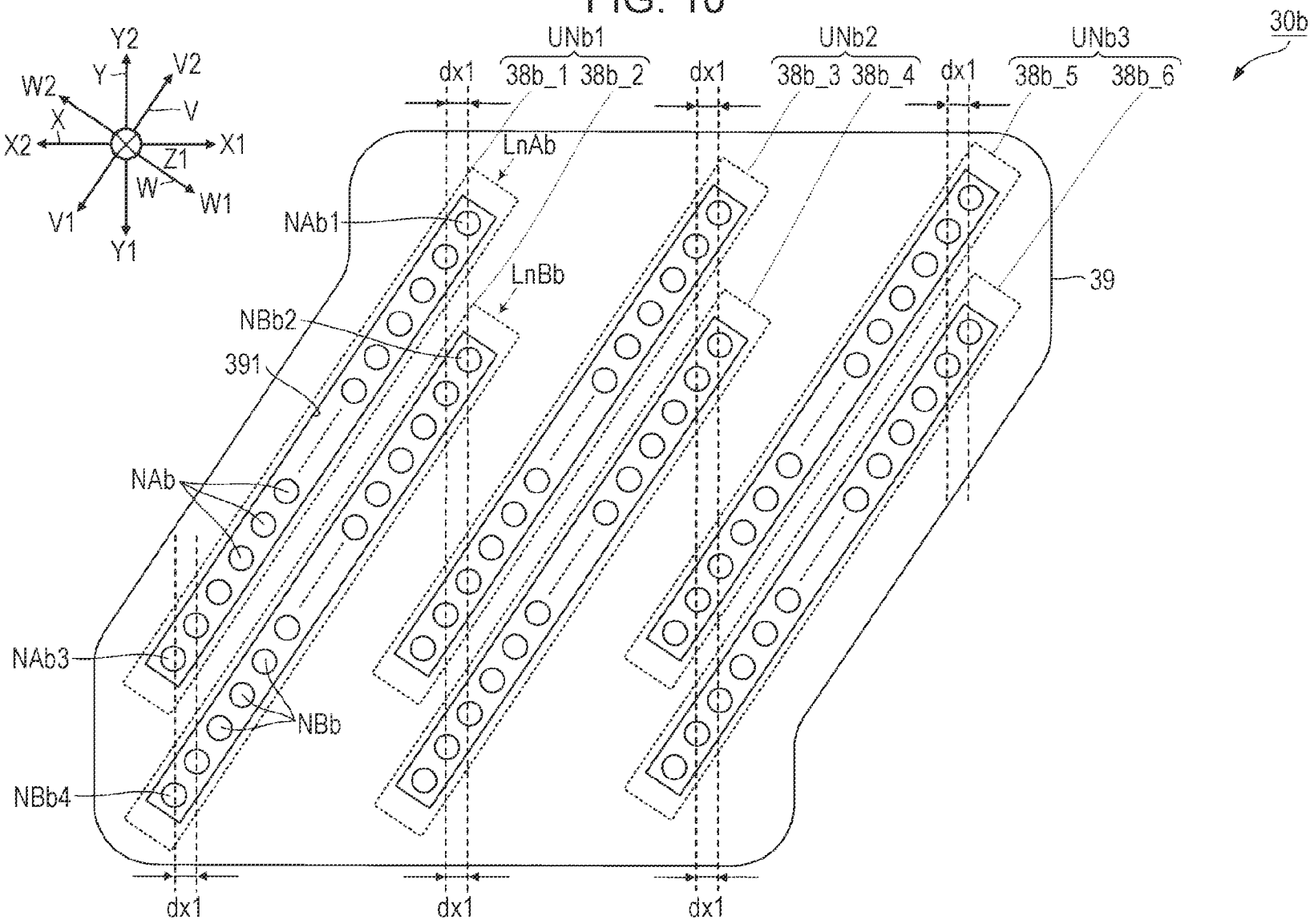
FIG. 10 is diagram of a liquid ejecting head according to a second embodiment when viewed in the Z1 direction.

FIG. 10 is a diagram of a liquid ejecting head 30*b* according to the second embodiment when viewed in the Z1 direction. The liquid ejecting head 30*b* has a plurality of head chips 38*b*. The head chip 38*b* has the same configuration as the head chip 38, but differs from the first embodiment in that the arrangement position of the fixing plate 39 is different. The plurality of head chips 38*b* have a set UNb1 including a head chip 38*b*_1 and a head chip 38*b*_2, a set UNb2 including a head chip 38*b*_3 and a head chip 38*b*_4, and a UNb3 including a head chip 38*b*_5 and a head chip 38*b*_6.

Although not shown in FIG. 10, in the second embodiment, the plurality of head chips 38 have a first chip group CGb1 and a second chip group CGb2. The first chip group CGb1 has head chips 38_1, 38_3, and 38_5. The second chip group CGb2 has head chips 38_2, 38_4, and 38_6. The head chip 38*b* included in the first chip group CGb1 are referred to as a "first head chip 38Ab", and the head chip 38 included in the second chip group CGb2 is referred to as a "second head chip 38Bb".

The nozzle row Ln of the first head chip 38Ab is referred to as a "first nozzle row LnAb", and the nozzle row Ln of the second head chip 38Bb is referred to as a "second nozzle row LnBb". Further, the nozzles N constituting the first nozzle row LnAb is referred to as "first nozzles NAb", and the nozzles N constituting the second nozzle row LnBb is referred to as "second nozzles NBb".

In the second embodiment, a first interval in the X1 direction between the center of a first nozzle NAb1 positioned foremost in the V2 direction in a first nozzle row LnAb included in the head chip 38*b*_1 and the center of a second nozzle NBb2 positioned foremost in the V2 direction in a second nozzle row LnBb included in the head chip 38*b*_2 is 0. In other words, the center of the first nozzle NAb1 and the center of the second nozzle NBb2 are at the same position in the X1 direction. Similarly, a second interval in the X1 direction between the center of a first nozzle NAb3 positioned foremost in the V1 direction in a first nozzle row LnAb included in the head chip 38*b*_1 and the center of a second nozzle NBb4 positioned foremost in the V1 direction in a second nozzle row LnBb included in the head chip 38*b*_2 is 0. In other words, the center of the first nozzle NAb3 and the center of the second nozzle NBb4 are at the same position in the X1 direction.

2.1. Summary of Second Embodiment

As described above, in the second embodiment, the first interval and the second interval are 0. Since the first interval and the second interval are 0, in the X-axis direction, there are second nozzle NBb in the same position as first nozzles NAb of each of the first head chips 38A included in the same set UN. Therefore, when the first ink and the second ink are inks of different colors, the liquid ejecting head 30*b* can form a high-quality image as compared with the liquid ejecting head 30 in the first embodiment. Specifically, in the image formed by the liquid ejecting head 30 in the first embodiment, the landing position for to one dot varies depending on the color of the ink. On the other hand, in the image formed by the liquid ejecting head 30*b*, the landing position for one dot does not vary depending on the color of the ink.

When the first ink and the second ink are inks of the same color, even if ejection failure occurs in one nozzle N of the first nozzle NAb and the second nozzle NBb that is located at the same position in the X-axis direction as the first nozzle Nab, which are included in the same set UN, the other nozzle N can suppress missing dots.

3. MODIFICATION EXAMPLE

Each of the above illustrated embodiments can be modified in various ways. A specific modes of modification examples are illustrated below. Any two or more modes selected from the following examples can be appropriately merged within the extent that they do not contradict each other.

3.1. First Modification Example

In the first embodiment and the second embodiment, one head chip 38 has one nozzle row Ln, but is not limited thereto. For example, one head chip 38 may have a plurality of nozzle rows Ln.

Figure 11:
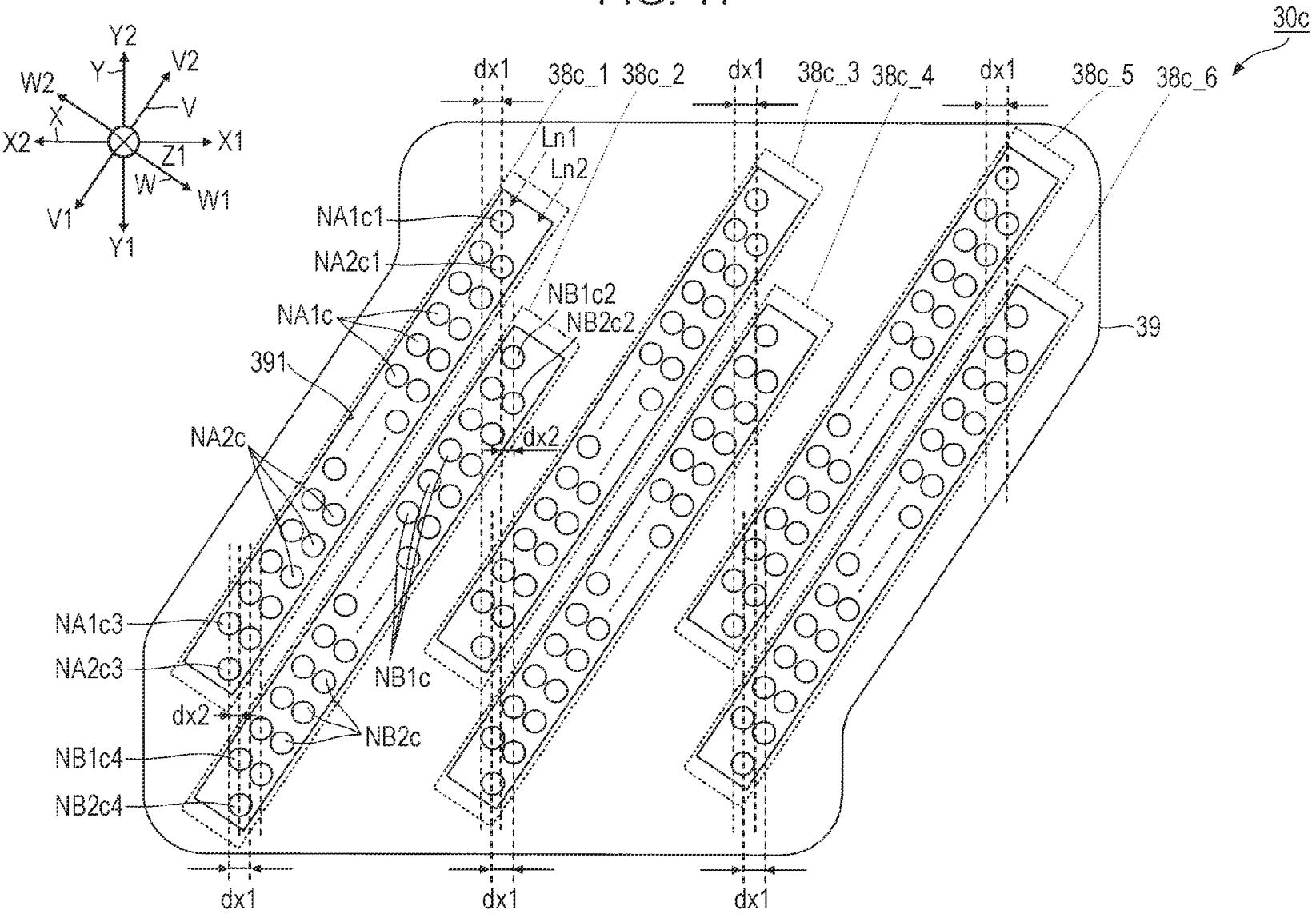
FIG. 11 is a diagram of a liquid ejecting head according to a first modification example when viewed in the Z1 direction.

FIG. 11 is a diagram of a liquid ejecting head 30*c* according to a first modification example when viewed in the Z1 direction. The liquid ejecting head 30*c* has head chips 38*c*_1, 38*c*_2, 38*c*_3, 38*c*_4, 38*c*_5, and 38*c*_6 as a plurality of head chips 38*c*. One head chip 38*c* has a nozzle row Ln1 and a nozzle row Ln2 as two nozzle rows Ln. In the following description, the nozzles N constituting the nozzle row Ln1 included in the head chip 38*c*_1 is referred to as "nozzles NA1*c*", and the nozzles N constituting the nozzle row Ln2 included in the head chip 38*c*_1 is referred to as "nozzles NA2*c*". Further, the nozzles N constituting the nozzle row Ln1 included in the head chip 38*c*_2 is referred to as "nozzles NB1*c*", and the nozzles N constituting the nozzle row Ln2 included in the head chip 38*c*_2 is referred to as "nozzles NB2*c*".

In the example of FIG. 11, the interval in the X1 direction between the center of a nozzle NA1*c*1 positioned foremost in the V2 direction among the plurality of nozzles NA1*c* and the center of a nozzle NA2*c*1 positioned foremost in the V2 direction among the plurality of nozzles NA2*c* is 0. Similarly, the interval in the X1 direction between the center of a nozzle NB1*c*2 positioned foremost in the V2 direction among the plurality of nozzles NB1*c* and the center of a nozzle NB2*c*2 positioned foremost in the V2 direction among the plurality of nozzles NB2*c* is 0. Further, the interval in the X1 direction between the center of a nozzle NA1*c*3 positioned foremost in the V1 direction among the plurality of nozzles NA1*c* and the center of a nozzle NA2*c*3 positioned foremost in the V1 direction among the plurality of nozzles NA2*c* is 0. Similarly, the interval in the X1 direction between the center of a nozzle NB1*c*4 positioned foremost in the V1 direction among the plurality of nozzles NB1*c* and the center of a nozzle NB2*c*4 positioned foremost in the V1 direction among the plurality of nozzles NB2*c* is 0.

On the other hand, the distance between the center of the nozzle NA1*c*1 and the center of the nozzle NB1*c*2 is the second length dx2. Similarly, the distance between the center of the nozzle NA1*c*3 and the center of the nozzle NB1*c*4 is the second length dx2.

The interval in the X1 direction between the nozzles N shown in FIG. 11 is an example, and is not limited thereto. For example, the interval in the X1 direction between the nozzles N may be adjusted such that a resolution four times a single unit resolution can be achieved. Specifically, the interval in the X1 direction between the center of the nozzle NA1*c*1 and the center of the nozzle NA2*c*1, the interval in the X1 direction between the center of the nozzle NA2*c*1 and the center of the nozzle NB1*c*2, and the interval in the X1 direction between the center of the nozzle NB1*c*2 and the center of the nozzle NB2*c*2 is half of the second length dx2.

The color of the ink supplied to the nozzle row Ln1 included in the head chip 38*c*_1, the color of the ink supplied to the nozzle row Ln2 included in the head chip 38*c*_1, the color of the ink supplied to the nozzle row Ln1 included in the head chip 38*c*_2, and the color of the ink supplied to the nozzle row Ln2 included in the head chip 38*c*_2 may be all the same or different from each other. As an example in which all the ink colors are different, yellow ink is supplied to the nozzle row Ln1 included in the head chip 38*c*_1, magenta ink is supplied to the nozzle row Ln2 included in the head chip 38*c*_1, cyan ink is supplied to the nozzle row Ln1 included in the head chip 38*c*_2, and black ink is supplied to the nozzle row Ln2 included in the head chip 38*c*_2.

3.2. Second Modification Example

In addition to above modes, a temperature sensor 392 may be provided on the surface of the fixing plate 39 in the Z1 direction.

Figure 12:
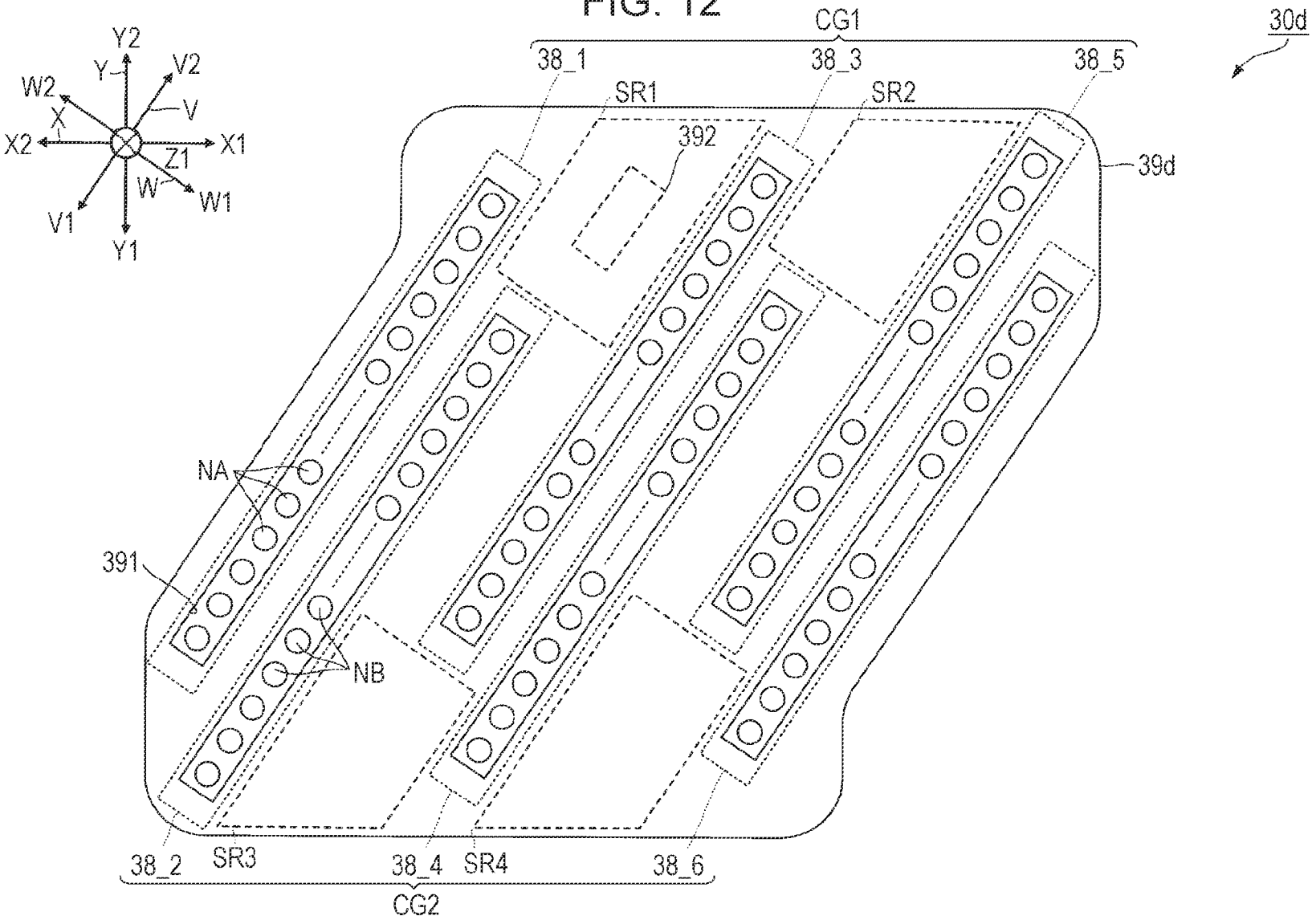
FIG. 12 is a diagram of a liquid ejecting head according to a second modification example when viewed in the Z1 direction.

FIG. 12 is a diagram of a liquid ejecting head 30*d* according to a second modification example when viewed in the Z1 direction. The liquid ejecting head 30*d* has a fixing plate 39*d*. On the surface of the fixing plate 39*d* in the Z2 direction, the temperature sensor 392 is provided to be accommodated in a recess provided on the surface of the holder 37 (not shown) in the Z2 direction. In the second modification example, the temperature sensor 392 is provided in a region SR1. The region SR1 is a region on the surface of the fixing plate 39*d* in the Z2 direction which, in plan view, is surrounded by a part of the side in the Y2 direction, a part near the end in the V2 direction which the side of the head chip 38_1 in the W1 direction has, the side of the head chip 38_2 in the V2 direction, and a part near the end in the V2 direction which the side of the head chip 38_3 in the W2 direction has.

By providing the temperature sensor 392 in the region SR1 which is an empty space where the head chip 38 of the fixing plate 39*d* does not exist, the empty space can be effectively utilized.

In the second modification example, one temperature sensor 392 is provided in the region SR1, but is not limited thereto. A plurality of temperature sensors 392 may be provided on the surface of the fixing plate 39 in the Z1 direction. Further, one or more temperature sensors 392 may be provided in at least one region of a region SR2, a region SR3, and a region SR4 illustrated in FIG. 12. The region SR2 is a region on the surface of the fixing plate 39*d* in the Z1 direction which, in plan view, is surrounded by a part of the side in the Y2 direction, a part near the end in the V2 direction which the side of the head chip 38_3 in the W1 direction has, the side of the head chip 38_4 in the V2 direction, and a part near the end in the V2 direction which the side of the head chip 38_5 in the W2 direction has.

The region SR3 is a region on the surface of the fixing plate 39*d* in the Z1 direction which, in plan view, is surrounded by a part of the side in the Y1 direction, a part near the end in the V1 direction which the side of the head chip 38_2 in the W1 direction has, the side of the head chip 38_3 in the V1 direction, and a part near the end in the V1 direction which the side of the head chip 38_4 in the W2 direction has. The region SR4 is a region on the surface of the fixing plate 39*d* in the Z1 direction which is surrounded by a part of the side in the Y1 direction, a part near the end in the V1 direction which the side of the head chip 38_4 in the W1 direction has, the side of the head chip 38_5 in the V1 direction, and a part near the end in the V1 direction which the side of the head chip 38_6 in the W2 direction has.

Further, although not shown, from a position of the surface of the fixing plate 39*d* in the Z2 direction, which is overlapped with a portion of at least one of the region SR1, the region SR2, the region SR3, and the region SR4 in plan view, a protrusion protruding in the Z2 direction may be provided. With this configuration, it is possible to suppress the contact of the medium PP with the nozzle surface FN of the fixing plate 39*d*. The protrusion may be formed integrally with the fixing plate 39*d*, or may be provided as a separate member being joined to the surface of the fixing plate 39*d* in the Z2 direction.

3.3. Third Modification Example

In each of the above modes, the plurality of head chips 38 included in the liquid ejecting head 30 have two chip groups, the first chip group CG1 and the second chip group CG2, but may have three or more chip groups. When the plurality of head chips 38 according to the third modification example have three chip groups and one head chip 38 has one nozzle row Ln, the liquid ejecting head 30 according to the third modification example can obtain a resolution three times of a single unit resolution by appropriately arranging the plurality of head chips 38.

3.4. Fourth Modification Example

In the first embodiment, the first interval and the second interval are the second length dx2, but may be greater than 0 and less than the second length dx2.

3.5. Fifth Modification Example

In the first embodiment, in two adjacent first head chips 38A among the plurality of first head chips 38A, one first head chip 38A disposed in the X1 direction is disposed offset from the other first head chip 38A in the Y2 direction; however, the present disclosure is not limited thereto. For example, two adjacent first head chips 38A among the plurality of first head chips 38A may be arranged so as not to offset in the Y2 direction, that is, may all overlap when viewed in the X1 direction.

3.6. Sixth Modification Example

In the first embodiment, the first distance, which is the interval in the W1 direction between the head chips 38 in one set UN, is shorter than the second distance, which is the interval in the W1 direction between the head chips 38 in the adjacent sets UN, but the present disclosure is not limited thereto. For example, the first distance may coincide with the second distance or may be longer.

3.7. Seventh Modification Example

The liquid ejecting apparatus 100 described above is a so-called line-type liquid ejecting apparatus in which the head module 3 is fixed and printing is performed simply by transporting the medium PP, but the configuration of the line-type recording device is not limited to that described above. For example, each of the above modes can also be applied to a so-called serial type liquid ejecting apparatus in which the head module 3 or the plurality of liquid ejecting heads 30 are mounted on a carriage, and printing is performed by moving the head module 3 or the plurality of liquid ejecting heads 30 in the X-axis direction and transporting the medium PP. When applied to a serial type liquid ejecting apparatus, the X-axis direction in the first embodiment is used as the transport direction of the medium PP.

3.8. Eighth Modification Example

In each of the above modes, the liquid ejecting head 30 may serve as an energy generating element for generating energy in the pressure chambers CB to eject ink, and may have a heat generating element instead of the piezoelectric element PZq used in each of the above modes.

3.9. Ninth Modification Example

The liquid ejecting apparatus described above can be employed in various devices such as a facsimile machine and a copier, in addition to a device dedicated to printing. However, the application of the liquid ejecting apparatus of the present disclosure is not limited to printing. For example, the liquid ejecting apparatus for ejecting a solution of a coloring material is used as a manufacturing device for forming a color filter of a liquid crystal display device. Further, the liquid ejecting apparatus for ejecting a solution of a conductive material is used as a manufacturing device for forming wiring and electrodes on a wiring substrate.

4. APPENDIX

For example, the following configurations can be understood from the embodiments exemplified above.

According to Aspect 1, which is a preferred aspect, there is provided a liquid ejecting head including a plurality of head chips that eject a liquid toward a medium in a first direction, in which, when a width direction of the medium is a second direction, a direction orthogonal to the first direction and the second direction is a third direction, and a direction perpendicular to the first direction and intersecting the second direction and the third direction is a fourth direction, the plurality of head chips include a first chip group in which a plurality of first head chips are arranged side by side in the second direction, the first head chip having a first nozzle row formed by arranging a plurality of first nozzles side by side in the fourth direction, and a second chip group in which a plurality of second head chips are arranged side by side in the second direction, the second head chip having a second nozzle row formed by arranging a plurality of second nozzles side by side in the fourth direction, and the first chip group is arranged side by side in the third direction with respect to the second chip group.

According to Aspect 1, since the first chip group and the second chip group are arranged in one liquid ejecting head, the positioning accuracy of the first chip group and the second chip group can be improved as compared with an aspect in which the first chip group and the second chip group are arranged in different liquid ejecting heads.

In Aspect 2, which is a specific example of Aspect 1, the first chip group and the second chip group partially overlap each other when viewed in the second direction.

According to Aspect 2, the size of the liquid ejecting head in the third direction can be reduced.

In Aspect 3, which is a specific example of Aspect 2, one second head chip α of the plurality of second head chips is located next to one first head chip α of the plurality of first head chips, and located in the second direction with respect to the first head chip α, and the second head chip α is located next to one first head chip β of the plurality of first head chips, which is different from the first head chip α, and located in a direction opposite to the second direction with respect to the first head chip β.

In Aspect 4, which is a specific example of any one of Aspects 1 to 3, the first chip group and the second chip group have a plurality of sets including adjacent first and second head chips among the plurality of first head chips and the plurality of second head chips, in the same set among the plurality of sets, the first head chip is located next to the second head chip and located in the third direction with respect to the second head chip, an interval in the second direction between centers of first nozzles adjacent to each other in the first nozzle row is a first length, an interval in the second direction between centers of the second nozzles adjacent to each other in the second nozzle row is the first length, and in the first nozzle row and the second nozzle row included in the same set among the plurality of sets, a first interval in the second direction between a center of a first nozzle positioned foremost in the fourth direction in the first nozzle row and a center of a second nozzle positioned foremost in the fourth direction in the second nozzle row is equal to or less than a second length that is half the first length, and a second interval in the second direction between a center of a first nozzle positioned foremost in a direction opposite to the fourth direction in the first nozzle row and a center of a second nozzle positioned foremost in the direction opposite to the fourth direction in the second nozzle row is equal to or less than the second length.

In the aspect in which the second length is longer than the first length, when printing at a high resolution, in the second direction, a part where a higher resolution than the resolution achieved by one head chip can be achieved and a part where a high resolution cannot be achieved are generated, and the nozzles N in the part where the high resolution cannot be achieved are made useless. On the other hand, according to the Aspect 4, the part where a high resolution cannot be achieved can be prevented from being generated. Further, in the aspect in which the second length is longer than the first length, when printing in multiple colors, in the second direction, a part where multiple colors can be achieved and a part where multiple colors cannot be achieved are generated, and the nozzles in the part where multiple colors cannot be achieved are made useless. On the other hand, according to the Aspect 4, the part where multiple colors cannot be achieved can be prevented from being generated.

In Aspect 5, which is a specific example of Aspect 4, the first interval and the second interval are the second length.

According to Aspect 5, when the first ink and the second ink are inks of the same color, a resolution twice the resolution achieved by one head chip can be achieved.

In Aspect 6, which is a specific example of Aspect 4, the first interval and the second interval are 0.

According to Aspect 6, when the first ink and the second ink are inks of different colors, the liquid ejecting head in Aspect 6 can form an image with high image quality as compared with an aspect in which the first interval and the second interval are greater than 0.

In Aspect 7, which is a specific example of any one of Aspects 4 to 6, the plurality of sets include a first set and a second set adjacent to each other, and when a direction perpendicular to the first direction and orthogonal to the fourth direction is a fifth direction, a distance in the fifth direction between the first head chip and the second head chip that are included in the first set is shorter than a distance in the fifth direction between a head chip disposed closest to the second set adjacent to the first set among the plurality of head chips included in the first set and a head chip disposed closest to the first set among the plurality of head chips included in the second set.

According to Aspect 7, the landing accuracy of the droplets ejected from the nozzles can be improved as compared with an aspect in which the first distance is equal to or greater than the second distance, even when the medium is transported with inclination with respect to the third direction.

In Aspect 8, which is a specific example of any one of Aspects 1 to 7, the fourth direction is a direction between the second direction and the third direction, in two adjacent first head chips among the plurality of first head chips, one first head chip disposed in the second direction is disposed offset from the other first head chip in the third direction, and in two adjacent second head chips among the plurality of second head chips, one second head chip disposed in the second direction is disposed offset from the other second head chip in the third direction.

According to Aspect 8, when a plurality of liquid ejecting heads are arranged side by side in the second direction, the distance between the plurality of liquid ejecting heads can be increased while maintaining the number of nozzles N overlapped with each other in the third direction between the liquid ejecting heads as compared with an aspect in which a plurality of first head chips are arranged side by side in the second direction.

According to Aspect 9, which is a preferred aspect, there is provided a liquid ejecting head including the liquid ejecting head according to any one of Aspects 1 to 8, and a transport portion that transports the medium.

According to Aspect 9, a liquid ejecting apparatus can be provided that is capable of improving the positioning accuracy of the first chip group and the second chip group.

According to Aspect 10, which is a preferred aspect, there is provided a liquid ejecting apparatus including a line head in which a plurality of the liquid ejecting heads according to any one of Aspects 1 to 8 are provided side by side in the second direction.

According to Aspect 10, a liquid ejecting apparatus can be provided that has a line head in which a plurality of liquid ejecting heads capable of improving the positioning accuracy of the first chip group and the second chip group are provided side by side.

What is claimed is:

1. A liquid ejecting head comprising:

head chips configured to eject a liquid toward a medium in a first direction, wherein when a width direction of the medium is a second direction, a direction orthogonal to the first direction and the second direction is a third direction, and a direction perpendicular to the first direction and intersecting the second direction and the third direction is a fourth direction, the head chips include:

a first chip group in which first head chips are arranged side by side in the second direction, the first head chip having a first nozzle row formed by arranging first nozzles side by side in the fourth direction; and a second chip group in which second head chips are arranged side by side in the second direction, the second head chip having a second nozzle row formed by arranging second nozzles side by side in the fourth direction, the first chip group is arranged side by side in the third direction with respect to the second chip group, the first head chips adjacent to each other are overlapped with each other when viewed in the third direction, and the second head chips adjacent to each other are overlapped with each other when viewed in the third direction.

2. The liquid ejecting head according to claim 1, wherein the first chip group and the second chip group partially overlap each other when viewed in the second direction.

3. The liquid ejecting head according to claim 2, wherein one second head chip α of the second head chips is located next to one first head chip α of the first head chips, and located in the second direction with respect to the first head chip α, and the second head chip α is located next to one first head chip β of the first head chips, which is different from the first head chip α, and located in a direction opposite to the second direction with respect to the first head chip β.

4. A liquid ejecting apparatus comprising:

the liquid ejecting head according to claim 3; and a transport portion that transports the medium.

5. A liquid ejecting apparatus comprising:

a line head in which a plurality of the liquid ejecting heads according to claim 3 are provided side by side in the second direction.

6. A liquid ejecting apparatus comprising:

the liquid ejecting head according to claim 2; and a transport portion that transports the medium.

7. A liquid ejecting apparatus comprising:

a line head in which a plurality of the liquid ejecting heads according to claim 2 are provided side by side in the second direction.

8. The liquid ejecting head according to claim 1, wherein an interval in the second direction between centers of first nozzles adjacent to each other in the first nozzle row is a first length, an interval in the second direction between centers of the second nozzles adjacent to each other in the second nozzle row is the first length, and in the first nozzle row and the second nozzle row included in the same set among the sets, a first interval in the second direction between a center of a first nozzle positioned foremost in the fourth direction in the first nozzle row and a center of a second nozzle positioned foremost in the fourth direction in the second nozzle row is equal to or less than a second length that is half the first length, and a second interval in the second direction between a center of a first nozzle positioned foremost in a direction opposite to the fourth direction in the first nozzle row and a center of a second nozzle positioned foremost in the direction opposite to the fourth direction in the second nozzle row is equal to or less than the second length.

9. The liquid ejecting head according to claim 8, wherein the first interval and the second interval are the second length.

10. The liquid ejecting head according to claim 8, wherein the first interval and the second interval are 0.

11. The liquid ejecting head according to claim 8, wherein the sets include a first set and a second set adjacent to each other, and when a direction perpendicular to the first direction and orthogonal to the fourth direction is a fifth direction, a distance in the fifth direction between the first head chip and the second head chip of the first set is shorter than a distance in the fifth direction between a head chip disposed closest to the second set among the head chips of the first set and a head chip disposed closest to the first set among the head chips of the second set.

12. The liquid ejecting head according to claim 1, wherein the fourth direction is a direction between the second direction and the third direction, in two adjacent first head chips among the first head chips, one first head chip disposed in the second direction is disposed offset from the other first head chip in the third direction, and in two adjacent second head chips among the second head chips, one second head chip disposed in the second direction is disposed offset from the other second head chip in the third direction.

13. A liquid ejecting apparatus comprising:

the liquid ejecting head according to claim 1; and a transport portion that transports the medium.

14. A liquid ejecting apparatus comprising:

a line head in which a plurality of the liquid ejecting heads according to claim 1 are provided side by side in the second direction.

15. The liquid ejecting head according to the claim 1, wherein each of the first head chips is located in the third direction with respect to all of the second head chips.

16. The liquid ejecting head according to the claim 1, wherein the first chip group and the second chip group have sets respectively including adjacent first head chip and second head chip among the first and second head chips, in the same set among the sets, the first head chip is located next to the second head chip and located in the third direction with respect to the second head chip, the sets include a first set and a second set adjacent to each other, and the first and second head chips of the first set and the first and second head chips of the second set are partially overlapped with each other when viewed in the third direction.

17. A liquid ejecting head comprising:

head chips configured to eject a liquid toward a medium in a first direction, wherein when a width direction of the medium is a second direction, a direction orthogonal to the first direction and the second direction is a third direction, and a direction perpendicular to the first direction and intersecting the second direction and the third direction is a fourth direction, the head chips include:

a first chip group in which first head chips are arranged side by side in the second direction, the first head chip having a first nozzle row formed by arranging first nozzles side by side in the fourth direction; and a second chip group in which second head chips are arranged side by side in the second direction, the second head chip having a second nozzle row formed by arranging second nozzles side by side in the fourth direction, the first chip group is arranged side by side in the third direction with respect to the second chip group, and the first chip group and the second chip group substantially overlap each other when viewed in the third direction.

18. The liquid ejecting head according to the claim 17, wherein each of the first head chips is located in the third direction with respect to all of the second head chips.

19. A liquid ejecting head comprising:

head chips configured to eject a liquid toward a medium in a first direction, wherein when a width direction of the medium is a second direction, a direction orthogonal to the first direction and the second direction is a third direction, and a direction perpendicular to the first direction and intersecting the second direction and the third direction is a fourth direction, the head chips include:

a first chip group in which first head chips are arranged side by side in the second direction, the first head chip having a first nozzle row formed by arranging first nozzles side by side in the fourth direction; and a second chip group in which second head chips are arranged side by side in the second direction, the second head chip having a second nozzle row formed by arranging second nozzles side by side in the fourth direction, the first chip group is arranged side by side in the third direction with respect to the second chip group, end portions of the first head chips of the first chip group are arranged side by side to overlap a first virtual straight line when viewed in the first direction, end portions of the second head chips of the second chip group are arranged side by side to overlap a second virtual straight line when viewed in the first direction, and the first virtual line located in the third direction with respect to the second virtual straight line.

20. The liquid ejecting head according to the claim 19, wherein each of the first head chips is located in the third direction with respect to all of the second head chips.

* * * * *